US009399905B2

(12) United States Patent
Nguyen

(10) Patent No.: US 9,399,905 B2
(45) Date of Patent: Jul. 26, 2016

(54) LEAK DETECTION IN CIRCULATED FLUID SYSTEMS FOR HEATING SUBSURFACE FORMATIONS

(71) Applicant: Shell Oil Company, Houston, TX (US)

(72) Inventor: Scott Vinh Nguyen, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 14/703,350

(22) Filed: May 4, 2015

(65) Prior Publication Data

US 2016/0053609 A1 Feb. 25, 2016

Related U.S. Application Data

(60) Continuation of application No. 14/160,031, filed on Jan. 21, 2014, now Pat. No. 9,022,109, which is a division of application No. 13/083,246, filed on Apr. 8, 2011, now Pat. No. 8,631,866.

(60) Provisional application No. 61/322,643, filed on Apr. 9, 2010, provisional application No. 61/322,513, filed on Apr. 9, 2010.

(51) Int. Cl.

| | |
|---|---|
| ***E21B 43/24*** | (2006.01) |
| ***E21B 36/00*** | (2006.01) |
| ***E21B 36/04*** | (2006.01) |
| ***E21B 43/30*** | (2006.01) |
| ***E21B 47/10*** | (2012.01) |

(52) U.S. Cl.

CPC ..... *E21B 43/24* (2013.01); *E21B 36/00* (2013.01); *E21B 36/04* (2013.01); *E21B 43/2401* (2013.01); *E21B 43/305* (2013.01); *E21B 47/10* (2013.01); *E21B 47/102* (2013.01); *E21B 47/1025* (2013.01)

(58) Field of Classification Search

None

See application file for complete search history.

(56) References Cited

U.S. PATENT DOCUMENTS

| | | | |
|---|---|---|---|
| 48,994 | A | 7/1865 | Parry |
| 94,813 | A | 9/1885 | Dickey |
| 326,439 | A | 9/1885 | McEachen |
| 345,586 | A | 7/1886 | Hall |
| 760,304 | A | 5/1904 | Butler |

(Continued)

FOREIGN PATENT DOCUMENTS

| | | |
|---|---|---|
| CA | 899987 | 5/1972 |
| CA | 1168283 | 5/1984 |

(Continued)

OTHER PUBLICATIONS

"IEEE Recommended Practice for Electrical Impedance, Induction, and Skin Effect Heating of Pipelines and Vessels", IEEE Std. 844-200, 2000, 6 pages.

(Continued)

*Primary Examiner* — Angela M DiTrani
*Assistant Examiner* — Anuradha Ahuja

(57) ABSTRACT

A method of treating a subsurface formation includes circulating at least one molten salt through at least one conduit of a conduit-in-conduit heater located in the formation to heat hydrocarbons in the formation to at least a mobilization temperature of the hydrocarbons. At least some of the hydrocarbons are produced from the formation. An electrical resistance of at least one of the conduits of the conduit-in-conduit heater is assessed to assess a presence of a leak in at least one of the conduits.

19 Claims, 13 Drawing Sheets

(56) References Cited

U.S. PATENT DOCUMENTS

| | | | |
|---|---|---|---|
| 1,269,747 | A | 6/1918 | Rogers |
| 1,342,741 | A | 6/1920 | Day |
| 1,457,479 | A | 6/1923 | Wolcott |
| 1,510,655 | A | 6/1924 | Clark |
| 1,634,236 | A | 6/1927 | Ranney |
| 1,646,599 | A | 10/1927 | Schaefer |
| 1,660,818 | A | 2/1928 | Ranney |
| 1,666,488 | A | 4/1928 | Crawshaw |
| 1,681,523 | A | 8/1928 | Downey et al. |
| 1,811,560 | A | 6/1931 | Ranney |
| 1,913,395 | A | 6/1933 | Karrick |
| 2,144,144 | A | 1/1939 | Crickmer |
| 2,244,255 | A | 6/1941 | Looman |
| 2,244,256 | A | 6/1941 | Looman |
| 2,319,702 | A | 5/1943 | Moon |
| 2,365,591 | A | 12/1944 | Ranney |
| 2,381,256 | A | 8/1945 | Callaway |
| 2,390,770 | A | 12/1945 | Barton et al. |
| 2,423,674 | A | 7/1947 | Agren |
| 2,444,755 | A | 7/1948 | Steffen |
| 2,466,945 | A | 4/1949 | Greene |
| 2,472,445 | A | 6/1949 | Sprong |
| 2,481,051 | A | 9/1949 | Uren |
| 2,484,063 | A | 10/1949 | Ackley |
| 2,497,868 | A | 2/1951 | Dalin |
| 2,548,360 | A | 4/1951 | Germain |
| 2,593,477 | A | 4/1952 | Newman et al. |
| 2,595,979 | A | 5/1952 | Pevere et al. |
| 2,623,596 | A | 12/1952 | Whorton et al. |
| 2,630,306 | A | 3/1953 | Evans |
| 2,630,307 | A | 3/1953 | Martin |
| 2,634,961 | A | 4/1953 | Ljungstrom |
| 2,642,943 | A | 6/1953 | Smith et al. |
| 2,670,802 | A | 3/1954 | Ackley |
| 2,685,930 | A | 8/1954 | Albaugh |
| 2,695,163 | A | 11/1954 | Pearce et al. |
| 2,703,621 | A | 3/1955 | Ford |
| 2,714,930 | A | 8/1955 | Carpenter |
| 2,732,195 | A | 1/1956 | Ljungstrom |
| 2,734,579 | A | 2/1956 | Elkins |
| 2,743,906 | A | 5/1956 | Coyle |
| 2,757,739 | A | 8/1956 | Douglas et al. |
| 2,759,877 | A | 8/1956 | Eron |
| 2,761,663 | A | 9/1956 | Gerdetz |
| 2,771,954 | A | 11/1956 | Jenks et al. |
| 2,777,679 | A | 1/1957 | Ljungstrom |
| 2,780,449 | A | 2/1957 | Fisher et al. |
| 2,780,450 | A | 2/1957 | Ljungstrom |
| 2,786,660 | A | 3/1957 | Alleman |
| 2,789,805 | A | 4/1957 | Ljungstrom |
| 2,793,696 | A | 5/1957 | Morse |
| 2,794,504 | A | 6/1957 | Carpenter |
| 2,799,341 | A | 7/1957 | Maly |
| 2,801,089 | A | 7/1957 | Scott, Jr. |
| 2,803,305 | A | 8/1957 | Behning et al. |
| 2,804,149 | A | 8/1957 | Kile |
| 2,819,761 | A | 1/1958 | Popham et al. |
| 2,825,408 | A | 3/1958 | Watson |
| 2,841,375 | A | 7/1958 | Salomonsson |
| 2,857,002 | A | 10/1958 | Pevere et al. |
| 2,647,306 | A | 12/1958 | Stewart et al. |
| 2,862,558 | A | 12/1958 | Dixon |
| 2,889,882 | A | 6/1959 | Schleicher |
| 2,890,754 | A | 6/1959 | Hoffstrom et al. |
| 2,890,755 | A | 6/1959 | Eurenius et al. |
| 2,902,270 | A | 9/1959 | Salomonsson et al. |
| 2,906,337 | A | 9/1959 | Henning |
| 2,906,340 | A | 9/1959 | Herzog |
| 2,914,309 | A | 11/1959 | Salomonsson |
| 2,923,535 | A | 2/1960 | Ljungstrom |
| 2,932,352 | A | 4/1960 | Stegemeier |
| 2,939,689 | A | 6/1960 | Ljungstrom |
| 2,942,223 | A | 6/1960 | Lennox et al. |
| 2,954,826 | A | 10/1960 | Sievers |
| 2,958,519 | A | 11/1960 | Hurley |
| 2,969,226 | A | 1/1961 | Huntington |
| 2,970,826 | A | 2/1961 | Woodruff |
| 2,974,937 | A | 3/1961 | Kiel |
| 2,991,046 | A | 7/1961 | Yahn |
| 2,994,376 | A | 8/1961 | Crawford et al. |
| 2,997,105 | A | 8/1961 | Campion et al. |
| 2,998,457 | A | 8/1961 | Paulsen |
| 3,004,601 | A | 10/1961 | Bodine |
| 3,004,603 | A | 10/1961 | Rogers et al. |
| 3,007,521 | A | 11/1961 | Trantham et al. |
| 3,010,513 | A | 11/1961 | Gerner |
| 3,010,516 | A | 11/1961 | Schleicher |
| 3,016,053 | A | 1/1962 | Medovick |
| 3,017,168 | A | 1/1962 | Carr |
| 3,026,940 | A | 3/1962 | Spitz |
| 3,032,102 | A | 5/1962 | Parker |
| 3,036,632 | A | 5/1962 | Koch et al. |
| 3,044,545 | A | 7/1962 | Tooke |
| 3,048,221 | A | 8/1962 | Tek |
| 3,050,123 | A | 8/1962 | Scott |
| 3,051,235 | A | 8/1962 | Banks |
| 3,057,404 | A | 10/1962 | Berstrom |
| 3,061,009 | A | 10/1962 | Shirley |
| 3,062,282 | A | 11/1962 | Schleicher |
| 3,095,031 | A | 6/1963 | Eurenius et al. |
| 3,097,690 | A | 7/1963 | Terwilliger et al. |
| 3,105,545 | A | 10/1963 | Prats et al. |
| 3,106,244 | A | 10/1963 | Parker |
| 3,110,345 | A | 11/1963 | Reed et al. |
| 3,113,619 | A | 12/1963 | Reichle |
| 3,113,620 | A | 12/1963 | Hemminger |
| 3,113,623 | A | 12/1963 | Krueger |
| 3,114,417 | A | 12/1963 | McCarthy |
| 3,116,792 | A | 1/1964 | Purre |
| 3,120,264 | A | 2/1964 | Barron |
| 3,127,935 | A | 4/1964 | Poettmann et al. |
| 3,127,936 | A | 4/1964 | Eurenius |
| 3,131,763 | A | 5/1964 | Kunetka et al. |
| 3,132,692 | A | 5/1964 | Marx et al. |
| 3,137,347 | A | 6/1964 | Parker |
| 3,138,203 | A | 6/1964 | Weiss et al. |
| 3,139,928 | A | 7/1964 | Broussard |
| 3,142,336 | A | 7/1964 | Doscher |
| 3,149,670 | A | 9/1964 | Grant |
| 3,149,672 | A | 9/1964 | Orkiszewski et al. |
| 3,150,715 | A | 9/1964 | Dietz |
| 3,163,745 | A | 12/1964 | Boston |
| 3,164,207 | A | 1/1965 | Thessen et al. |
| 3,165,154 | A | 1/1965 | Santourian |
| 3,170,842 | A | 2/1965 | Kehler |
| 3,181,613 | A | 5/1965 | Krueger |
| 3,182,721 | A | 5/1965 | Hardy |
| 3,183,675 | A | 5/1965 | Schroeder |
| 3,191,679 | A | 6/1965 | Miller |
| 3,205,942 | A | 9/1965 | Sandberg |
| 3,205,944 | A | 9/1965 | Walton |
| 3,205,946 | A | 9/1965 | Prats et al. |
| 3,207,220 | A | 9/1965 | Williams |
| 3,208,531 | A | 9/1965 | Tamplen |
| 3,209,825 | A | 10/1965 | Alexander et al. |
| 3,221,505 | A | 12/1965 | Goodwin et al. |
| 3,221,811 | A | 12/1965 | Prats |
| 3,233,668 | A | 2/1966 | Hamilton et al. |
| 3,237,689 | A | 3/1966 | Justheim |
| 3,241,611 | A | 3/1966 | Dougan |
| 3,246,695 | A | 4/1966 | Robinson |
| 3,250,327 | A | 5/1966 | Crider |
| 3,267,680 | A | 8/1966 | Schlumberger |
| 3,272,261 | A | 9/1966 | Morse |
| 3,273,640 | A | 9/1966 | Huntington |
| 3,275,076 | A | 9/1966 | Sharp |
| 3,284,281 | A | 11/1966 | Thomas |
| 3,285,335 | A | 11/1966 | Reistle, Jr. |
| 3,288,648 | A | 11/1966 | Jones |
| 3,294,167 | A | 12/1966 | Vogel |
| 3,302,707 | A | 2/1967 | Slusser |
| 3,303,883 | A | 2/1967 | Slusser |
| 3,310,109 | A | 3/1967 | Marx et al. |
| 3,316,344 | A | 4/1967 | Kidd et al. |

(56) References Cited

U.S. PATENT DOCUMENTS 3,316,962 A 5/1967 Lange
3,332,480 A 7/1967 Parrish
3,338,306 A 8/1967 Cook
3,342,258 A 9/1967 Prats
3,342,267 A 9/1967 Cotter et al.
3,346,044 A 10/1967 Slusser
3,349,845 A 10/1967 Holbert et al.
3,352,355 A 11/1967 Putman
3,358,756 A 12/1967 Vogel
3,362,751 A 1/1968 Tinlin
3,372,754 A 3/1968 McDonald
3,379,248 A 4/1968 Strange
3,380,913 A 4/1968 Henderson
3,386,508 A 6/1968 Bielstein et al.
3,389,975 A 6/1968 Van Nostrand
3,399,623 A 9/1968 Creed
3,410,796 A 11/1968 Hull
3,410,977 A 11/1968 Ando
3,412,011 A 11/1968 Lindsay
3,434,541 A 3/1969 Cook et al.
3,455,383 A 7/1969 Prats et al.
3,465,819 A 9/1969 Dixon
3,477,058 A 11/1969 Vedder et al.
3,480,082 A 11/1969 Gilliland
3,485,300 A 12/1969 Engle
3,492,463 A 1/1970 Wringer et al.
3,501,201 A 3/1970 Closmann et al.
3,502,372 A 3/1970 Prats
3,513,913 A 5/1970 Bruist
3,515,213 A 6/1970 Prats
3,515,837 A 6/1970 Ando
3,526,095 A 9/1970 Peck
3,528,501 A 9/1970 Parker
3,529,682 A 9/1970 Coyne et al.
3,537,528 A 11/1970 Herce et al.
3,542,131 A 11/1970 Walton et al.
3,547,192 A 12/1970 Claridge et al.
3,547,193 A 12/1970 Gill
3,554,285 A 1/1971 Meldau
3,562,401 A 2/1971 Long
3,565,171 A 2/1971 Closmann
3,578,080 A 5/1971 Closmann
3,580,987 A 5/1971 Priaroggia
3,593,789 A 7/1971 Prats
3,595,082 A 7/1971 Miller
3,599,714 A 8/1971 Messman et al.
3,605,890 A 9/1971 Holm
3,614,986 A 10/1971 Gill
3,617,471 A 11/1971 Schlinger et al.
3,618,663 A 11/1971 Needham
3,629,551 A 12/1971 Ando
3,647,358 A 3/1972 Greenberg
3,661,423 A 5/1972 Garret
3,675,715 A 7/1972 Speller, Jr.
3,679,812 A 7/1972 Owens
3,680,633 A 8/1972 Bennett
3,700,280 A 10/1972 Papadopoulos et al.
3,757,860 A 9/1973 Pritchett
3,759,328 A 9/1973 Ueber et al.
3,759,574 A 9/1973 Beard
3,761,599 A 9/1973 Beatty
3,766,982 A 10/1973 Justheim
3,770,398 A 11/1973 Abraham et al.
3,779,602 A 12/1973 Beard et al.
3,794,113 A 2/1974 Strange et al.
3,794,116 A 2/1974 Higgins
3,804,169 A 4/1974 Closmann
3,804,172 A 4/1974 Closmann et al.
3,809,159 A 5/1974 Young et al.
3,812,913 A 5/1974 Hardy et al.
3,853,185 A 12/1974 Dahl et al.
3,881,551 A 5/1975 Terry et al.
3,882,941 A 5/1975 Pelofsky
3,892,270 A 7/1975 Lindquist
3,893,918 A 7/1975 Favret, Jr.
3,894,769 A 7/1975 Tham et al.
3,907,045 A 9/1975 Dahl et al.
3,922,148 A 11/1975 Child
3,924,680 A 12/1975 Terry
3,933,447 A 1/1976 Pasini, III et al.
3,941,421 A 3/1976 Burton, III et al.
3,943,160 A 3/1976 Farmer, III et al.
3,946,812 A 3/1976 Gale et al.
3,947,683 A 3/1976 Schultz et al.
3,948,319 A 4/1976 Pritchett
3,948,755 A 4/1976 McCollum et al.
3,950,029 A 4/1976 Timmins
3,952,802 A 4/1976 Terry
3,954,140 A 5/1976 Hendrick
3,972,372 A 8/1976 Fisher et al.
3,973,628 A 8/1976 Colgate
3,986,349 A 10/1976 Egan
3,986,556 A 10/1976 Haynes
3,986,557 A 10/1976 Striegler et al.
3,987,851 A 10/1976 Tham
3,992,474 A 11/1976 Sobel
3,993,132 A 11/1976 Cram et al.
3,994,340 A 11/1976 Anderson et al.
3,994,341 A 11/1976 Anderson et al.
3,999,607 A 12/1976 Pennington et al.
4,005,752 A 2/1977 Cha
4,006,778 A 2/1977 Redford et al.
4,008,762 A 2/1977 Fisher et al.
4,010,800 A 3/1977 Terry
4,014,575 A 3/1977 French et al.
4,016,239 A 4/1977 Fenton
4,018,280 A 4/1977 Daviduk et al.
4,019,575 A 4/1977 Pisio et al.
4,026,357 A 5/1977 Redford
4,029,360 A 6/1977 French
4,031,956 A 6/1977 Terry
4,037,655 A 7/1977 Carpenter
4,037,658 A 7/1977 Anderson
4,042,026 A 8/1977 Pusch et al.
4,043,393 A 8/1977 Fisher et al.
4,048,637 A 9/1977 Jacomini
4,049,053 A 9/1977 Fisher et al.
4,057,293 A 11/1977 Garrett
4,059,308 A 11/1977 Pearson et al.
4,064,943 A 12/1977 Cavin
4,065,183 A 12/1977 Hill et al.
4,067,390 A 1/1978 Camacho et al.
4,069,868 A 1/1978 Terry
4,076,761 A 2/1978 Chang et al.
4,077,471 A 3/1978 Shupe et al.
4,083,604 A 4/1978 Bohn et al.
4,084,637 A 4/1978 Todd
4,085,803 A 4/1978 Butler
4,087,130 A 5/1978 Garrett
4,089,372 A 5/1978 Terry
4,089,373 A 5/1978 Reynolds et al.
4,089,374 A 5/1978 Terry
4,091,869 A 5/1978 Hoyer
4,093,025 A 6/1978 Terry
4,093,026 A 6/1978 Ridley
4,096,163 A 6/1978 Chang et al.
4,099,567 A 7/1978 Terry
4,114,688 A 9/1978 Terry
4,119,349 A 10/1978 Albulescu et al.
4,125,159 A 11/1978 Vann
4,130,575 A 12/1978 Jorn et al.
4,133,825 A 1/1979 Stroud et al.
4,138,442 A 2/1979 Chang et al.
4,140,180 A 2/1979 Bridges et al.
4,140,181 A 2/1979 Ridley et al.
4,144,935 A 3/1979 Bridges et al.
4,148,359 A 4/1979 Laumbach et al.
4,151,068 A 4/1979 McCollum et al.
4,151,877 A 5/1979 French
RE30,019 E 6/1979 Lindquist
4,158,467 A 6/1979 Larson et al.
4,162,707 A 7/1979 Yan
4,169,506 A 10/1979 Berry
4,183,405 A 1/1980 Magnie

(56) References Cited

U.S. PATENT DOCUMENTS

| | | | |
|---|---|---|---|
| 4,184,548 | A | 1/1980 | Ginsburgh et al. |
| 4,185,692 | A | 1/1980 | Terry |
| 4,186,801 | A | 2/1980 | Madgavkar et al. |
| 4,193,451 | A | 3/1980 | Dauphine |
| 4,197,911 | A | 4/1980 | Anada |
| 4,199,024 | A | 4/1980 | Rose et al. |
| 4,199,025 | A | 4/1980 | Carpenter |
| 4,216,079 | A | 8/1980 | Newcombe |
| 4,228,853 | A | 10/1980 | Harvey et al. |
| 4,228,854 | A | 10/1980 | Sacuta |
| 4,234,230 | A | 11/1980 | Weichman |
| 4,243,101 | A | 1/1981 | Grupping |
| 4,243,511 | A | 1/1981 | Allred |
| 4,248,306 | A | 2/1981 | Van Huisen et al. |
| 4,250,230 | A | 2/1981 | Terry |
| 4,250,962 | A | 2/1981 | Madgavkar et al. |
| 4,252,191 | A | 2/1981 | Pusch et al. |
| 4,256,945 | A | 3/1981 | Carter et al. |
| 4,258,955 | A | 3/1981 | Habib, Jr. |
| 4,260,192 | A | 4/1981 | Shafer |
| 4,265,307 | A | 5/1981 | Elkins |
| 4,273,188 | A | 6/1981 | Vogel et al. |
| 4,274,487 | A | 6/1981 | Hollingsworth et al. |
| 4,277,416 | A | 7/1981 | Grant |
| 4,282,587 | A | 8/1981 | Silverman |
| 4,285,547 | A | 8/1981 | Weichman |
| RE30,738 | E | 9/1981 | Bridges et al. |
| 4,299,086 | A | 11/1981 | Madgavkar et al. |
| 4,299,285 | A | 11/1981 | Tsai et al. |
| 4,303,126 | A | 12/1981 | Blevins |
| 4,305,463 | A | 12/1981 | Zakiewicz |
| 4,306,621 | A | 12/1981 | Boyd et al. |
| 4,324,292 | A | 4/1982 | Jacobs et al. |
| 4,344,483 | A | 8/1982 | Fisher et al. |
| 4,353,418 | A | 10/1982 | Hoekstra et al. |
| 4,359,687 | A | 11/1982 | Vinegar et al. |
| 4,363,361 | A | 12/1982 | Madgavkar et al. |
| 4,366,668 | A | 1/1983 | Madgavkar et al. |
| 4,366,864 | A | 1/1983 | Gibson et al. |
| 4,378,048 | A | 3/1983 | Madgavkar et al. |
| 4,380,930 | A | 4/1983 | Podhrasky et al. |
| 4,381,641 | A | 5/1983 | Madgavkar et al. |
| 4,382,469 | A | 5/1983 | Bell et al. |
| 4,384,613 | A | 5/1983 | Owen et al. |
| 4,384,614 | A | 5/1983 | Justheim |
| 4,385,661 | A | 5/1983 | Fox |
| 4,390,067 | A | 6/1983 | Willman |
| 4,390,973 | A | 6/1983 | Rietsch |
| 4,396,062 | A | 8/1983 | Iskander |
| 4,397,732 | A | 8/1983 | Hoover et al. |
| 4,398,151 | A | 8/1983 | Vinegar et al. |
| 4,399,866 | A | 8/1983 | Dearth |
| 4,401,099 | A | 8/1983 | Collier |
| 4,401,162 | A | 8/1983 | Osborne |
| 4,401,163 | A | 8/1983 | Elkins |
| 4,407,973 | A | 10/1983 | van Dijk et al. |
| 4,409,090 | A | 10/1983 | Hanson et al. |
| 4,410,042 | A | 10/1983 | Shu |
| 4,412,124 | A | 10/1983 | Kobayashi |
| 4,412,585 | A | 11/1983 | Bouck |
| 4,415,034 | A | 11/1983 | Bouck |
| 4,417,782 | A | 11/1983 | Clarke et al. |
| 4,418,752 | A | 12/1983 | Boyer et al. |
| 4,423,311 | A | 12/1983 | Varney, Sr. |
| 4,425,967 | A | 1/1984 | Hoekstra |
| 4,428,700 | A | 1/1984 | Lennemann |
| 4,429,745 | A | 2/1984 | Cook |
| 4,437,519 | A | 3/1984 | Cha et al. |
| 4,439,307 | A | 3/1984 | Jaquay et al. |
| 4,440,224 | A | 4/1984 | Kreinin et al. |
| 4,442,896 | A | 4/1984 | Reale et al. |
| 4,444,255 | A | 4/1984 | Geoffrey et al. |
| 4,444,258 | A | 4/1984 | Kalmar |
| 4,445,574 | A | 5/1984 | Vann |
| 4,446,917 | A | 5/1984 | Todd |
| 4,448,251 | A | 5/1984 | Stine |
| 4,449,594 | A | 5/1984 | Sparks |
| 4,452,491 | A | 6/1984 | Seglin et al. |
| 4,455,215 | A | 6/1984 | Jarrott et al. |
| 4,456,065 | A | 6/1984 | Heim et al. |
| 4,457,365 | A | 7/1984 | Kasevich et al. |
| 4,457,374 | A | 7/1984 | Hoekstra et al. |
| 4,458,757 | A | 7/1984 | Bock et al. |
| 4,458,767 | A | 7/1984 | Hoehn, Jr. |
| 4,460,044 | A | 7/1984 | Porter |
| 4,463,988 | A | 8/1984 | Bouck et al. |
| 4,474,236 | A | 10/1984 | Kellett |
| 4,474,238 | A | 10/1984 | Gentry et al. |
| 4,479,541 | A | 10/1984 | Wang |
| 4,485,868 | A | 12/1984 | Sresty et al. |
| 4,485,869 | A | 12/1984 | Sresty et al. |
| 4,487,257 | A | 12/1984 | Dauphine |
| 4,489,782 | A | 12/1984 | Perkins |
| 4,491,179 | A | 1/1985 | Pirson et al. |
| 4,498,531 | A | 2/1985 | Vrolyk |
| 4,498,535 | A | 2/1985 | Bridges |
| 4,499,209 | A | 2/1985 | Hoek et al. |
| 4,501,326 | A | 2/1985 | Edmunds |
| 4,501,445 | A | 2/1985 | Gregoli |
| 4,513,816 | A | 4/1985 | Hubert |
| 4,518,548 | A | 5/1985 | Yarbrough |
| 4,524,826 | A | 6/1985 | Savage |
| 4,524,827 | A | 6/1985 | Bridges et al. |
| 4,530,401 | A | 7/1985 | Hartman et al. |
| 4,537,252 | A | 8/1985 | Puri |
| 4,538,682 | A | 9/1985 | McManus et al. |
| 4,540,882 | A | 9/1985 | Vinegar et al. |
| 4,542,648 | A | 9/1985 | Vinegar et al. |
| 4,544,478 | A | 10/1985 | Kelley |
| 4,545,435 | A | 10/1985 | Bridges et al. |
| 4,549,396 | A | 10/1985 | Garwood et al. |
| 4,552,214 | A | 11/1985 | Forgac et al. |
| 4,570,715 | A | 2/1986 | Van Meurs et al. |
| 4,571,491 | A | 2/1986 | Vinegar et al. |
| 4,572,299 | A | 2/1986 | Van Egmond et al. |
| 4,573,530 | A | 3/1986 | Audeh et al. |
| 4,576,231 | A | 3/1986 | Dowling et al. |
| 4,577,503 | A | 3/1986 | Imaino et al. |
| 4,577,690 | A | 3/1986 | Medlin |
| 4,577,691 | A | 3/1986 | Huang et al. |
| 4,583,046 | A | 4/1986 | Vinegar et al. |
| 4,583,242 | A | 4/1986 | Vinegar et al. |
| 4,585,066 | A | 4/1986 | Moore et al. |
| 4,592,423 | A | 6/1986 | Savage et al. |
| 4,597,441 | A | 7/1986 | Ware et al. |
| 4,597,444 | A | 7/1986 | Hutchinson |
| 4,598,392 | A | 7/1986 | Pann |
| 4,598,770 | A | 7/1986 | Shu et al. |
| 4,598,772 | A | 7/1986 | Holmes |
| 4,605,489 | A | 8/1986 | Madgavkar |
| 4,605,680 | A | 8/1986 | Beuther et al. |
| 4,608,818 | A | 9/1986 | Goebel et al. |
| 4,609,041 | A | 9/1986 | Magda |
| 4,613,754 | A | 9/1986 | Vinegar et al. |
| 4,616,705 | A | 10/1986 | Stegemeier et al. |
| 4,620,592 | A | 11/1986 | Perkins |
| 4,623,401 | A | 11/1986 | Derbyshire et al. |
| 4,623,444 | A | 11/1986 | Che et al. |
| 4,626,665 | A | 12/1986 | Fort, III |
| 4,634,187 | A | 1/1987 | Huff et al. |
| 4,635,197 | A | 1/1987 | Vinegar et al. |
| 4,637,464 | A | 1/1987 | Forgac et al. |
| 4,640,352 | A | 2/1987 | Van Meurs et al. |
| 4,640,353 | A | 2/1987 | Schuh |
| 4,643,256 | A | 2/1987 | Dilgren et al. |
| 4,644,283 | A | 2/1987 | Vinegar et al. |
| 4,645,906 | A | 2/1987 | Yagnik et al. |
| 4,651,825 | A | 3/1987 | Wilson |
| 4,658,215 | A | 4/1987 | Vinegar et al. |
| 4,662,437 | A | 5/1987 | Renfro et al. |
| 4,662,438 | A | 5/1987 | Taflove et al. |
| 4,662,439 | A | 5/1987 | Puri |
| 4,662,443 | A | 5/1987 | Puri et al. |
| 4,663,711 | A | 5/1987 | Vinegar et al. |

(56) References Cited

U.S. PATENT DOCUMENTS 4,669,542 A 6/1987 Venkatesan
4,671,102 A 6/1987 Vinegar et al.
4,682,652 A 7/1987 Huang et al.
4,691,771 A 9/1987 Ware et al.
4,694,907 A 9/1987 Stahl et al.
4,695,713 A 9/1987 Krumme
4,696,345 A 9/1987 Hsueh
4,698,149 A 10/1987 Mitchell
4,698,583 A 10/1987 Sandberg
4,701,587 A 10/1987 Carter et al.
4,704,514 A 11/1987 Van Edmond et al.
4,706,751 A 11/1987 Gondouin
4,716,960 A 1/1988 Eastlund et al.
4,717,814 A 1/1988 Krumme
4,719,423 A 1/1988 Vinegar et al.
4,728,892 A 3/1988 Vinegar et al.
4,730,162 A 3/1988 Vinegar et al.
4,733,057 A 3/1988 Stanzel et al.
4,734,115 A 3/1988 Howard et al.
4,743,854 A 5/1988 Vinegar et al.
4,744,245 A 5/1988 White
4,752,673 A 6/1988 Krumme
4,756,367 A 7/1988 Puri et al.
4,762,425 A 8/1988 Shakkottai et al.
4,766,958 A 8/1988 Faecke
4,769,602 A 9/1988 Vinegar et al.
4,769,606 A 9/1988 Vinegar et al.
4,772,634 A 9/1988 Farooque
4,776,638 A 10/1988 Hahn
4,778,586 A 10/1988 Bain et al.
4,785,163 A 11/1988 Sandberg
4,787,452 A 11/1988 Jennings, Jr.
4,793,409 A 12/1988 Bridges et al.
4,794,226 A 12/1988 Derbyshire
4,808,925 A 2/1989 Baird
4,814,587 A 3/1989 Carter
4,815,791 A 3/1989 Schmidt et al.
4,817,711 A 4/1989 Jeambey
4,818,370 A 4/1989 Gregoli et al.
4,821,798 A 4/1989 Bridges et al.
4,823,890 A 4/1989 Lang
4,827,761 A 5/1989 Vinegar et al.
4,828,031 A 5/1989 Davis
4,842,448 A 6/1989 Koerner et al.
4,848,460 A 7/1989 Johnson, Jr. et al.
4,848,924 A 7/1989 Nuspl et al.
4,849,611 A 7/1989 Whitney et al.
4,856,341 A 8/1989 Vinegar et al.
4,856,587 A 8/1989 Nielson
4,860,544 A 8/1989 Krieg et al.
4,866,983 A 9/1989 Vinegar et al.
4,883,582 A 11/1989 McCants
4,884,455 A 12/1989 Vinegar et al.
4,885,080 A 12/1989 Brown et al.
4,886,118 A 12/1989 Van Meurs et al.
4,893,504 A 1/1990 OMeara, Jr. et al.
4,895,206 A 1/1990 Price
4,912,971 A 4/1990 Jeambey
4,913,065 A 4/1990 Hemsath
4,926,941 A 5/1990 Glandt et al.
4,927,857 A 5/1990 McShea, III et al.
4,928,765 A 5/1990 Nielson
4,940,095 A 7/1990 Newman
4,974,425 A 12/1990 Krieg et al.
4,982,786 A 1/1991 Jennings, Jr.
4,983,319 A 1/1991 Gregoli et al.
4,984,594 A 1/1991 Vinegar et al.
4,985,313 A 1/1991 Penneck et al.
4,987,368 A 1/1991 Vinegar
4,994,093 A 2/1991 Wetzel et al.
5,008,085 A 4/1991 Bain et al.
5,011,329 A 4/1991 Nelson et al.
5,020,596 A 6/1991 Hemsath
5,027,896 A 7/1991 Anderson
5,032,042 A 7/1991 Schuring et al.
5,041,210 A 8/1991 Merril, Jr. et al.
5,042,579 A 8/1991 Glandt et al.
5,043,668 A 8/1991 Vail, III
5,046,559 A 9/1991 Glandt
5,046,560 A 9/1991 Teletzke et al.
5,050,386 A 9/1991 Krieg et al.
5,054,551 A 10/1991 Duerksen
5,059,303 A 10/1991 Taylor et al.
5,060,287 A 10/1991 Van Egmond
5,060,726 A 10/1991 Glandt et al.
5,064,006 A 11/1991 Waters et al.
5,065,501 A 11/1991 Henschen et al.
5,065,818 A 11/1991 Van Egmond
5,066,852 A 11/1991 Willbanks
5,070,533 A 12/1991 Bridges et al.
5,073,625 A 12/1991 Derbyshire
5,082,054 A 1/1992 Kiamanesh
5,082,055 A 1/1992 Hemsath
5,085,276 A 2/1992 Rivas et al.
5,097,903 A 3/1992 Wilensky
5,099,918 A 3/1992 Bridges et al.
5,103,909 A 4/1992 Morgenthaler et al.
5,103,920 A 4/1992 Patton
5,109,928 A 5/1992 McCants
5,126,037 A 6/1992 Showalter
5,133,406 A 7/1992 Puri
5,145,003 A 9/1992 Duerksen
5,152,341 A 10/1992 Kaservich
5,168,927 A 12/1992 Stegemeier et al.
5,182,427 A 1/1993 McGaffigan
5,182,792 A 1/1993 Goncalves
5,189,283 A 2/1993 Carl, Jr. et al.
5,190,405 A 3/1993 Vinegar et al.
5,193,618 A 3/1993 Loh et al.
5,201,219 A 4/1993 Bandurski et al.
5,207,273 A 5/1993 Cates et al.
5,209,987 A 5/1993 Penneck et al.
5,211,230 A 5/1993 Ostapovich et al.
5,217,075 A 6/1993 Wittrisch
5,217,076 A 6/1993 Masek
5,226,961 A 7/1993 Nahm et al.
5,229,583 A 7/1993 van Egmond et al.
5,236,039 A 8/1993 Edelstein et al.
5,246,071 A 9/1993 Chu
5,255,740 A 10/1993 Talley
5,255,742 A 10/1993 Mikus
5,261,490 A 11/1993 Ebinuma
5,285,071 A 2/1994 LaCount
5,285,846 A 2/1994 Mohn
5,289,882 A 3/1994 Moore
5,295,763 A 3/1994 Stenborg et al.
5,297,626 A 3/1994 Vinegar et al.
5,305,239 A 4/1994 Kinra
5,305,829 A 4/1994 Kumar
5,306,640 A 4/1994 Vinegar et al.
5,316,664 A 5/1994 Gregoli et al.
5,318,116 A 6/1994 Vinegar et al.
5,318,709 A 6/1994 Wuest et al.
5,325,918 A 7/1994 Berryman et al.
5,332,036 A 7/1994 Shirley et al.
5,339,897 A 8/1994 Leaute
5,339,904 A 8/1994 Jennings, Jr.
5,340,467 A 8/1994 Gregoli et al.
5,349,859 A 9/1994 Kleppe
5,358,045 A 10/1994 Sevigny et al.
5,360,067 A 11/1994 Meo, III
5,363,094 A 11/1994 Staron et al.
5,366,012 A 11/1994 Lohbeck
5,377,756 A 1/1995 Northrop et al.
5,388,640 A 2/1995 Puri et al.
5,388,641 A 2/1995 Yee et al.
5,388,642 A 2/1995 Puri et al.
5,388,643 A 2/1995 Yee et al.
5,388,645 A 2/1995 Puri et al.
5,391,291 A 2/1995 Winquist et al.
5,392,854 A 2/1995 Vinegar et al.
5,400,430 A 3/1995 Nenniger
5,404,952 A 4/1995 Vinegar et al.
5,409,071 A 4/1995 Wellington et al.

(56) References Cited

U.S. PATENT DOCUMENTS

| | | | | |
|---|---|---|---|---|
| 5,411,086 | A | | 5/1995 | Burcham et al. |
| 5,411,089 | A | | 5/1995 | Vinegar et al. |
| 5,411,104 | A | | 5/1995 | Stanley |
| 5,415,231 | A | | 5/1995 | Northrop et al. |
| 5,431,224 | A | | 7/1995 | Laali |
| 5,433,271 | A | | 7/1995 | Vinegar et al. |
| 5,435,666 | A | | 7/1995 | Hassett et al. |
| 5,437,506 | A | | 8/1995 | Gray |
| 5,439,054 | A | | 8/1995 | Chaback et al. |
| 5,454,666 | A | | 10/1995 | Chaback et al. |
| 5,456,315 | A | | 10/1995 | Kisman et al. |
| 5,491,969 | A | | 2/1996 | Cohn et al. |
| 5,497,087 | A | | 3/1996 | Vinegar et al. |
| 5,498,960 | A | | 3/1996 | Vinegar et al. |
| 5,512,732 | A | | 4/1996 | Yagnik et al. |
| 5,517,593 | A | | 5/1996 | Nenniger et al. |
| 5,525,322 | A | | 6/1996 | Willms |
| 5,541,517 | A | | 7/1996 | Hartmann et al. |
| 5,545,803 | A | | 8/1996 | Heath et al. |
| 5,553,189 | A | | 9/1996 | Stegemeier et al. |
| 5,554,453 | A | | 9/1996 | Steinfeld et al. |
| 5,566,755 | A | | 10/1996 | Seidle et al. |
| 5,566,756 | A | | 10/1996 | Chaback et al. |
| 5,569,845 | A | * | 10/1996 | Butcher et al. ..... 73/64.44 |
| 5,571,403 | A | | 11/1996 | Scott et al. |
| 5,579,575 | A | | 12/1996 | Lamome et al. |
| 5,589,775 | A | | 12/1996 | Kuckes |
| 5,621,844 | A | | 4/1997 | Bridges |
| 5,621,845 | A | | 4/1997 | Bridges et al. |
| 5,624,188 | A | | 4/1997 | West |
| 5,632,336 | A | | 5/1997 | Notz et al. |
| 5,652,389 | A | | 7/1997 | Schaps et al. |
| 5,656,239 | A | | 8/1997 | Stegemeier et al. |
| RE35,696 | E | | 12/1997 | Mikus |
| 5,713,415 | A | | 2/1998 | Bridges |
| 5,723,423 | A | | 3/1998 | VanSlyke |
| 5,751,895 | A | | 5/1998 | Bridges |
| 5,759,022 | A | | 6/1998 | Koppang et al. |
| 5,760,307 | A | | 6/1998 | Latimer et al. |
| 5,769,569 | A | | 6/1998 | Hosseini |
| 5,777,229 | A | | 7/1998 | Geier et al. |
| 5,782,301 | A | | 7/1998 | Neuroth et al. |
| 5,802,870 | A | | 9/1998 | Arnold et al. |
| 5,826,653 | A | | 10/1998 | Rynne et al. |
| 5,826,655 | A | | 10/1998 | Snow et al. |
| 5,828,797 | A | | 10/1998 | Minott et al. |
| 5,861,137 | A | | 1/1999 | Edlund |
| 5,862,858 | A | | 1/1999 | Wellington et al. |
| 5,868,202 | A | | 2/1999 | Hsu |
| 5,879,110 | A | | 3/1999 | Carter |
| 5,899,269 | A | | 5/1999 | Wellington et al. |
| 5,899,958 | A | | 5/1999 | Dowell et al. |
| 5,911,898 | A | | 6/1999 | Jacobs et al. |
| 5,923,170 | A | | 7/1999 | Kuckes |
| 5,926,437 | A | | 7/1999 | Ortiz |
| 5,935,421 | A | | 8/1999 | Brons et al. |
| 5,958,365 | A | | 9/1999 | Liu |
| 5,968,349 | A | | 10/1999 | Duyvesteyn et al. |
| 5,984,010 | A | | 11/1999 | Elias et al. |
| 5,984,578 | A | | 11/1999 | Hanesian et al. |
| 5,984,582 | A | | 11/1999 | Schwert |
| 5,985,138 | A | | 11/1999 | Humphreys |
| 5,997,214 | A | | 12/1999 | de Rouffignac et al. |
| 6,015,015 | A | | 1/2000 | Lull et al. |
| 6,016,867 | A | | 1/2000 | Gregoli et al. |
| 6,016,868 | A | | 1/2000 | Gregoli et al. |
| 6,019,172 | A | | 2/2000 | Wellington et al. |
| 6,022,834 | A | | 2/2000 | Hsu et al. |
| 6,023,554 | A | | 2/2000 | Vinegar et al. |
| 6,026,914 | A | | 2/2000 | Adams et al. |
| 6,035,701 | A | | 3/2000 | Lowry et al. |
| 6,039,121 | A | | 3/2000 | Kisman |
| 6,049,508 | A | | 4/2000 | Deflandre |
| 6,056,057 | A | | 5/2000 | Vinegar et al. |
| 6,065,538 | A | | 5/2000 | Reimers et al. |
| 6,078,868 | A | | 6/2000 | Dubinsky |
| 6,079,499 | A | | 6/2000 | Mikus et al. |
| 6,084,826 | A | | 7/2000 | Leggett, III |
| 6,085,512 | A | | 7/2000 | Agee et al. |
| 6,088,294 | A | | 7/2000 | Leggett, III et al. |
| 6,094,048 | A | | 7/2000 | Vinegar et al. |
| 6,099,208 | A | | 8/2000 | McAlister |
| 6,102,122 | A | | 8/2000 | de Rouffignac |
| 6,102,137 | A | | 8/2000 | Ward et al. |
| 6,102,622 | A | | 8/2000 | Vinegar et al. |
| 6,110,358 | A | | 8/2000 | Aldous et al. |
| 6,112,808 | A | | 9/2000 | Isted |
| 6,152,987 | A | | 11/2000 | Ma et al. |
| 6,155,117 | A | | 12/2000 | Stevens et al. |
| 6,172,124 | B1 | | 1/2001 | Wolflick et al. |
| 6,173,775 | B1 | | 1/2001 | Elias et al. |
| 6,192,748 | B1 | | 2/2001 | Miller |
| 6,193,010 | B1 | | 2/2001 | Minto |
| 6,196,350 | B1 | | 3/2001 | Minto |
| 6,257,334 | B1 | | 7/2001 | Cyr et al. |
| 6,269,310 | B1 | | 7/2001 | Wash bourne |
| 6,269,881 | B1 | | 8/2001 | Chou et al. |
| 6,283,230 | B1 | | 9/2001 | Peters |
| 6,288,372 | B1 | | 9/2001 | Sandberg et al. |
| 6,318,469 | B1 | | 11/2001 | Patel |
| 6,328,104 | B1 | | 12/2001 | Graue |
| 6,353,706 | B1 | | 3/2002 | Bridges |
| 6,354,373 | B1 | | 3/2002 | Vercaemer et al. |
| 6,357,526 | B1 | | 3/2002 | Abdei-Halim et al. |
| 6,388,947 | B1 | | 5/2002 | Washbourne et al. |
| 6,412,559 | B1 | | 7/2002 | Gunter et al. |
| 6,422,318 | B1 | | 7/2002 | Rider |
| 6,427,124 | B1 | | 7/2002 | Dubinsky et al. |
| 6,429,784 | B1 | | 8/2002 | Beique et al. |
| 6,467,543 | B1 | | 10/2002 | Talwani et al. |
| 6,485,232 | B1 | | 11/2002 | Vinegar et al. |
| 6,499,536 | B1 | | 12/2002 | Ellingsen |
| 6,516,891 | B1 | | 2/2003 | Dallas |
| 6,540,018 | B1 | | 4/2003 | Vinegar |
| 6,581,684 | B2 | | 6/2003 | Wellington et al. |
| 6,584,406 | B1 | | 6/2003 | Harmon et al. |
| 6,585,046 | B2 | | 7/2003 | Neuroth et al. |
| 6,588,266 | B2 | | 7/2003 | Tubel et al. |
| 6,588,503 | B2 | | 7/2003 | Karanikas et al. |
| 6,588,504 | B2 | | 7/2003 | Wellington et al. |
| 6,591,906 | B2 | | 7/2003 | Wellington et al. |
| 6,591,907 | B2 | | 7/2003 | Zhang et al. |
| 6,607,033 | B2 | | 8/2003 | Wellington et al. |
| 6,609,570 | B2 | | 8/2003 | Wellington et al. |
| 6,679,332 | B2 | | 1/2004 | Vinegar et al. |
| 6,684,948 | B1 | | 2/2004 | Savage |
| 6,688,387 | B1 | | 2/2004 | Wellington et al. |
| 6,698,515 | B2 | | 3/2004 | Karanikas et al. |
| 6,702,016 | B2 | | 3/2004 | de Rouffignac et al. |
| 6,708,758 | B2 | | 3/2004 | de Rouffignac et al. |
| 6,712,135 | B2 | | 3/2004 | Wellington et al. |
| 6,712,136 | B2 | | 3/2004 | de Rouffignac et al. |
| 6,712,137 | B2 | | 3/2004 | Vinegar et al. |
| 6,715,546 | B2 | | 4/2004 | Vinegar et al. |
| 6,715,547 | B2 | | 4/2004 | Vinegar et al. |
| 6,715,548 | B2 | | 4/2004 | Wellington et al. |
| 6,715,550 | B2 | | 4/2004 | Vinegar et al. |
| 6,715,553 | B2 | | 4/2004 | Reddy et al. |
| 6,719,047 | B2 | | 4/2004 | Fowler et al. |
| 6,722,429 | B2 | | 4/2004 | de Rouffignac et al. |
| 6,722,430 | B2 | | 4/2004 | Vinegar et al. |
| 6,722,431 | B2 | | 4/2004 | Karanikas et al. |
| 6,725,920 | B2 | | 4/2004 | Zhang et al. |
| 6,725,928 | B2 | | 4/2004 | Vinegar et al. |
| 6,729,395 | B2 | | 5/2004 | Shahin, Jr. et al. |
| 6,729,396 | B2 | | 5/2004 | Vinegar et al. |
| 6,729,397 | B2 | | 5/2004 | Zhang et al. |
| 6,729,401 | B2 | | 5/2004 | Vinegar et al. |
| 6,732,794 | B2 | | 5/2004 | Wellington et al. |
| 6,732,795 | B2 | | 5/2004 | de Rouffignac et al. |
| 6,732,796 | B2 | | 5/2004 | Vinegar et al. |
| 6,736,215 | B2 | | 5/2004 | Maher et al. |
| 6,739,393 | B2 | | 5/2004 | Vinegar et al. |
| 6,739,394 | B2 | | 5/2004 | Vinegar et al. |

(56) References Cited

U.S. PATENT DOCUMENTS

| | | | |
|---|---|---|---|
| 6,742,587 | B2 | 6/2004 | Vinegar et al. |
| 6,742,588 | B2 | 6/2004 | Wellington et al. |
| 6,742,589 | B2 | 6/2004 | Berchenko et al. |
| 6,742,593 | B2 | 6/2004 | Vinegar et al. |
| 6,745,831 | B2 | 6/2004 | de Rouffignac et al. |
| 6,745,832 | B2 | 6/2004 | Wellington et al. |
| 6,745,837 | B2 | 6/2004 | Wellington et al. |
| 6,749,021 | B2 | 6/2004 | Vinegar et al. |
| 6,752,210 | B2 | 6/2004 | de Rouffignac et al. |
| 6,755,251 | B2 | 6/2004 | Thomas et al. |
| 6,758,268 | B2 | 7/2004 | Vinegar et al. |
| 6,761,216 | B2 | 7/2004 | Vinegar et al. |
| 6,763,886 | B2 | 7/2004 | Schoeling et al. |
| 6,769,483 | B2 | 8/2004 | de Rouffignac et al. |
| 6,769,485 | B2 | 8/2004 | Vinegar et al. |
| 6,782,947 | B2 | 8/2004 | de Rouffignac et al. |
| 6,789,625 | B2 | 9/2004 | de Rouffignac et al. |
| 6,805,194 | B2 | 10/2004 | Davidson et al. |
| 6,805,195 | B2 | 10/2004 | Vinegar et al. |
| 6,820,688 | B2 | 11/2004 | Vinegar et al. |
| 6,854,534 | B2 | 2/2005 | Livingstone |
| 6,854,929 | B2 | 2/2005 | Vinegar et al. |
| 6,866,097 | B2 | 3/2005 | Vinegar et al. |
| 6,871,707 | B2 | 3/2005 | Karanikas et al. |
| 6,877,554 | B2 | 4/2005 | Stegemeier et al. |
| 6,877,555 | B2 | 4/2005 | Karanikas et al. |
| 6,880,633 | B2 | 4/2005 | Wellington et al. |
| 6,880,635 | B2 | 4/2005 | Vinegar et al. |
| 6,889,769 | B2 | 5/2005 | Wellington et al. |
| 6,896,053 | B2 | 5/2005 | Berchenko et al. |
| 6,902,003 | B2 | 6/2005 | Maher et al. |
| 6,902,004 | B2 | 6/2005 | de Rouffignac et al. |
| 6,910,536 | B2 | 6/2005 | Wellington et al. |
| 6,910,537 | B2 | 6/2005 | Brown et al. |
| 6,913,078 | B2 | 7/2005 | Shahin, Jr. et al. |
| 6,913,079 | B2 | 7/2005 | Tubel |
| 6,915,850 | B2 | 7/2005 | Vinegar et al. |
| 6,918,442 | B2 | 7/2005 | Wellington et al. |
| 6,918,443 | B2 | 7/2005 | Wellington et al. |
| 6,918,444 | B2 | 7/2005 | Passey |
| 6,923,257 | B2 | 8/2005 | Wellington et al. |
| 6,923,258 | B2 | 8/2005 | Wellington et al. |
| 6,929,067 | B2 | 8/2005 | Vinegar et al. |
| 6,932,155 | B2 | 8/2005 | Vinegar et al. |
| 6,942,032 | B2 | 9/2005 | La Rovere et al. |
| 6,942,037 | B1 | 9/2005 | Arnold |
| 6,948,562 | B2 | 9/2005 | Wellington et al. |
| 6,948,563 | B2 | 9/2005 | Wellington et al. |
| 6,951,247 | B2 | 10/2005 | de Rouffignac et al. |
| 6,951,250 | B2 | 10/2005 | Reddy et al. |
| 6,953,087 | B2 | 10/2005 | de Rouffignac et al. |
| 6,958,704 | B2 | 10/2005 | Vinegar et al. |
| 6,959,761 | B2 | 11/2005 | Berchenko et al. |
| 6,964,300 | B2 | 11/2005 | Vinegar et al. |
| 6,966,372 | B2 | 11/2005 | Wellington et al. |
| 6,966,374 | B2 | 11/2005 | Vinegar et al. |
| 6,969,123 | B2 | 11/2005 | Vinegar et al. |
| 6,973,967 | B2 | 12/2005 | Stegemeier et al. |
| 6,981,548 | B2 | 1/2006 | Wellington et al. |
| 6,981,553 | B2 | 1/2006 | Stegemeier et al. |
| 6,991,032 | B2 | 1/2006 | Berchenko et al. |
| 6,991,033 | B2 | 1/2006 | Wellington et al. |
| 6,991,036 | B2 | 1/2006 | Sumnu-Dindoruk et al. |
| 6,991,045 | B2 | 1/2006 | Vinegar et al. |
| 6,994,160 | B2 | 2/2006 | Wellington et al. |
| 6,994,168 | B2 | 2/2006 | Wellington et al. |
| 6,994,169 | B2 | 2/2006 | Zhang et al. |
| 6,995,646 | B1 | 2/2006 | Fromm et al. |
| 6,997,255 | B2 | 2/2006 | Wellington et al. |
| 6,997,518 | B2 | 2/2006 | Vinegar et al. |
| 7,004,247 | B2 | 2/2006 | Cole et al. |
| 7,004,251 | B2 | 2/2006 | Ward et al. |
| 7,011,154 | B2 | 3/2006 | Maher et al. |
| 7,013,972 | B2 | 3/2006 | Vinegar et al. |
| RE39,077 | E | 4/2006 | Eaton |
| 7,032,660 | B2 | 4/2006 | Vinegar et al. |
| 7,032,809 | B1 | 4/2006 | Hopkins |
| 7,036,583 | B2 | 5/2006 | de Rouffignac et al. |
| 7,040,397 | B2 | 5/2006 | de Rouffignac et al. |
| 7,040,398 | B2 | 5/2006 | Wellington et al. |
| 7,040,399 | B2 | 5/2006 | Wellington et al. |
| 7,040,400 | B2 | 5/2006 | de Rouffignac et al. |
| 7,048,051 | B2 | 5/2006 | McQueen |
| 7,051,807 | B2 | 5/2006 | Vinegar et al. |
| 7,051,808 | B1 | 5/2006 | Vinegar et al. |
| 7,051,811 | B2 | 5/2006 | de Rouffignac et al. |
| 7,055,600 | B2 | 6/2006 | Messier et al. |
| 7,055,602 | B2 | 6/2006 | Shpakoff et al. |
| 7,063,145 | B2 | 6/2006 | Veenstra et al. |
| 7,066,254 | B2 | 6/2006 | Vinegar et al. |
| 7,066,257 | B2 | 6/2006 | Wellington et al. |
| 7,073,578 | B2 | 7/2006 | Vinegar et al. |
| 7,077,198 | B2 | 7/2006 | Vinegar et al. |
| 7,077,199 | B2 | 7/2006 | Vinegar et al. |
| RE39,244 | E | 8/2006 | Eaton |
| 7,086,465 | B2 | 8/2006 | Wellington et al. |
| 7,086,468 | B2 | 8/2006 | de Rouffignac et al. |
| 7,090,013 | B2 | 8/2006 | Wellington et al. |
| 7,096,941 | B2 | 8/2006 | de Rouffignac et al. |
| 7,096,942 | B1 | 8/2006 | de Rouffignac et al. |
| 7,096,953 | B2 | 8/2006 | de Rouffignac et al. |
| 7,100,994 | B2 | 9/2006 | Vinegar et al. |
| 7,104,319 | B2 | 9/2006 | Vinegar et al. |
| 7,114,566 | B2 | 10/2006 | Vinegar et al. |
| 7,114,880 | B2 | 10/2006 | Carter |
| 7,121,341 | B2 | 10/2006 | Vinegar et al. |
| 7,121,342 | B2 | 10/2006 | Vinegar et al. |
| 7,128,150 | B2 | 10/2006 | Thomas et al. |
| 7,128,153 | B2 | 10/2006 | Vinegar et al. |
| 7,147,057 | B2 | 12/2006 | Steele et al. |
| 7,147,059 | B2 | 12/2006 | Vinegar et al. |
| 7,153,373 | B2 | 12/2006 | Maziasz et al. |
| 7,156,176 | B2 | 1/2007 | Vinegar et al. |
| 7,165,615 | B2 | 1/2007 | Vinegar et al. |
| 7,170,424 | B2 | 1/2007 | Vinegar et al. |
| 7,204,327 | B2 | 4/2007 | Livingstone |
| 7,219,734 | B2 | 5/2007 | Bai et al. |
| 7,225,866 | B2 | 6/2007 | Berchenko et al. |
| 7,259,688 | B2 | 8/2007 | Hirsch et al. |
| 7,320,364 | B2 | 1/2008 | Fairbanks |
| 7,331,385 | B2 | 2/2008 | Symington et al. |
| 7,353,872 | B2 | 4/2008 | Sandberg et al. |
| 7,357,180 | B2 | 4/2008 | Vinegar et al. |
| 7,360,588 | B2 | 4/2008 | Vinegar et al. |
| 7,370,704 | B2 | 5/2008 | Harris |
| 7,383,877 | B2 | 6/2008 | Vinegar et al. |
| 7,424,915 | B2 | 9/2008 | Vinegar et al. |
| 7,431,076 | B2 | 10/2008 | Sandberg et al. |
| 7,435,037 | B2 | 10/2008 | McKinzie, II |
| 7,461,691 | B2 | 12/2008 | Vinegar et al. |
| 7,481,274 | B2 | 1/2009 | Vinegar et al. |
| 7,490,665 | B2 | 2/2009 | Sandberg et al. |
| 7,500,528 | B2 | 3/2009 | McKinzie et al. |
| 7,510,000 | B2 | 3/2009 | Pastor-Sanz et al. |
| 7,527,094 | B2 | 5/2009 | McKinzie et al. |
| 7,533,719 | B2 | 5/2009 | Hinson et al. |
| 7,540,324 | B2 | 6/2009 | de Rouffignac et al. |
| 7,546,873 | B2 | 6/2009 | Kim |
| 7,549,470 | B2 | 6/2009 | Vinegar et al. |
| 7,556,095 | B2 | 7/2009 | Vinegar |
| 7,556,096 | B2 | 7/2009 | Vinegar et al. |
| 7,559,367 | B2 | 7/2009 | Vinegar et al. |
| 7,559,368 | B2 | 7/2009 | Vinegar |
| 7,562,706 | B2 | 7/2009 | Li et al. |
| 7,562,707 | B2 | 7/2009 | Miller |
| 7,575,052 | B2 * | 8/2009 | Sandberg et al. ..... 166/248 |
| 7,575,053 | B2 | 8/2009 | Vinegar et al. |
| 7,581,589 | B2 | 9/2009 | Roes et al. |
| 7,584,789 | B2 | 9/2009 | Mo et al. |
| 7,591,310 | B2 | 9/2009 | Minderhoud et al. |
| 7,597,147 | B2 | 10/2009 | Vitek et al. |
| 7,604,052 | B2 | 10/2009 | Roes et al. |
| 7,610,962 | B2 | 11/2009 | Fowler |
| 7,631,689 | B2 | 12/2009 | Vinegar et al. |

(56) References Cited

U.S. PATENT DOCUMENTS 7,631,690 B2 12/2009 Vinegar et al.
7,635,023 B2 12/2009 Goldberg et al.
7,635,024 B2 12/2009 Karanikas et al.
7,635,025 B2 12/2009 Vinegar et al.
7,640,980 B2 1/2010 Vinegar et al.
7,644,765 B2 1/2010 Stegemeier et al.
7,673,681 B2 3/2010 Vinegar et al.
7,673,786 B2 3/2010 Menotti
7,677,310 B2 3/2010 Vinegar et al.
7,677,314 B2 3/2010 Hsu
7,681,647 B2 3/2010 Mudunuri et al.
7,683,296 B2 3/2010 Brady et al.
7,703,513 B2 4/2010 Vinegar et al.
7,717,171 B2 5/2010 Stegemeier et al.
7,730,945 B2 6/2010 Pieterson et al.
7,730,946 B2 6/2010 Vinegar et al.
7,730,947 B2 6/2010 Stegemeier et al.
7,735,935 B2 6/2010 Vinegar et al.
7,743,826 B2 6/2010 Harris
7,785,427 B2 8/2010 Maziasz et al.
7,793,722 B2 9/2010 Vinegar et al.
7,798,220 B2 9/2010 Vinegar et al.
7,798,221 B2 9/2010 Vinegar et al.
7,831,133 B2 11/2010 Vinegar et al.
7,831,134 B2 11/2010 Vinegar et al.
7,832,484 B2 * 11/2010 Nguyen et al. ..... 166/302
7,841,401 B2 11/2010 Kuhlman et al.
7,841,408 B2 11/2010 Vinegar
7,841,425 B2 11/2010 Mansure et al.
7,845,411 B2 * 12/2010 Vinegar et al. ..... 166/302
7,849,922 B2 12/2010 Vinegar et al.
7,860,377 B2 12/2010 Vinegar et al.
7,866,385 B2 1/2011 Lambirth
7,866,386 B2 1/2011 Beer
7,866,388 B2 1/2011 Bravo
7,931,086 B2 4/2011 Nguyen et al.
7,986,869 B2 7/2011 Vinegar et al.
8,027,571 B2 9/2011 Vinegar et al.
8,042,610 B2 10/2011 Harris et al.
8,113,272 B2 2/2012 Vinegar
8,146,661 B2 4/2012 Bravo et al.
8,162,059 B2 4/2012 Nguyen et al.
8,177,305 B2 5/2012 Burns et al.
8,191,630 B2 6/2012 Stegemeier et al.
8,196,658 B2 6/2012 Miller et al.
8,200,072 B2 6/2012 Vinegar et al.
8,220,539 B2 7/2012 Vinegar et al.
8,224,164 B2 7/2012 Sandberg et al.
8,224,165 B2 7/2012 Vinegar et al.
8,225,866 B2 7/2012 de Rouffignac
8,230,927 B2 7/2012 Fairbanks et al.
8,233,782 B2 7/2012 Vinegar et al.
8,238,730 B2 8/2012 Sandberg et al.
8,240,774 B2 8/2012 Vinegar et al.
8,256,512 B2 9/2012 Stanecki
8,257,112 B2 9/2012 Tilley
8,261,832 B2 9/2012 Ryan
8,267,185 B2 9/2012 Ocampos et al.
8,276,661 B2 10/2012 Costello et al.
8,281,861 B2 * 10/2012 Nguyen et al. ..... 166/302
8,327,932 B2 12/2012 Karanikas
8,355,623 B2 1/2013 Vinegar et al.
8,356,935 B2 1/2013 Drora et al.
8,381,815 B2 2/2013 Karanikas et al.
8,434,555 B2 5/2013 Bos et al.
8,450,540 B2 5/2013 Roes et al.
8,459,359 B2 6/2013 Vinegar
8,485,252 B2 7/2013 de Rouffignac
8,485,847 B2 7/2013 Tilley
8,502,120 B2 8/2013 Bass et al.
8,536,497 B2 9/2013 Kim
8,562,078 B2 10/2013 Burns et al.
8,606,091 B2 12/2013 John et al.
8,627,887 B2 1/2014 Vinegar et al.
8,631,866 B2 1/2014 Nguyen
8,636,323 B2 1/2014 Prince-Wright et al.
8,662,175 B2 3/2014 Karanikas et al.
8,701,768 B2 4/2014 Marino et al.
8,701,769 B2 4/2014 Beer
9,022,109 B2 * 5/2015 Nguyen ..... 166/250.01
2002/0027001 A1 3/2002 Wellington et al.
2002/0028070 A1 3/2002 Holen
2002/0033253 A1 3/2002 de Rouffignac et al.
2002/0036089 A1 3/2002 Vinegar et al.
2002/0038069 A1 3/2002 Wellington et al.
2002/0040779 A1 4/2002 Wellington et al.
2002/0040780 A1 4/2002 Wellington et al.
2002/0053431 A1 5/2002 Wellington et al.
2002/0076212 A1 6/2002 Zhang et al.
2002/0112890 A1 8/2002 Wentworth et al.
2002/0112987 A1 8/2002 Hou et al.
2002/0153141 A1 10/2002 Hartman et al.
2003/0029617 A1 2/2003 Brown et al.
2003/0066642 A1 4/2003 Wellington et al.
2003/0079877 A1 5/2003 Wellington et al.
2003/0085034 A1 5/2003 Wellington et al.
2003/0131989 A1 7/2003 Zakiewicz
2003/0146002 A1 8/2003 Vinegar et al.
2003/0157380 A1 8/2003 Assarabowski et al.
2003/0183390 A1 10/2003 Veenstra et al.
2003/0196789 A1 10/2003 Wellington et al.
2003/0201098 A1 10/2003 Karanikas et al.
2004/0035582 A1 2/2004 Zupanick
2004/0140096 A1 7/2004 Sandberg et al.
2004/0144540 A1 7/2004 Sandberg et al.
2004/0146288 A1 7/2004 Vinegar et al.
2005/0006097 A1 1/2005 Sandberg et al.
2005/0045325 A1 3/2005 Yu
2005/0269313 A1 12/2005 Vinegar et al.
2006/0052905 A1 3/2006 Pfingsten et al.
2006/0116430 A1 6/2006 Wentink
2006/0151166 A1 7/2006 Montgomery et al.
2006/0289536 A1 12/2006 Vinegar et al.
2007/0044957 A1 3/2007 Watson et al.
2007/0045267 A1 3/2007 Vinegar et al.
2007/0045268 A1 3/2007 Vinegar et al.
2007/0108201 A1 5/2007 Vinegar et al.
2007/0119098 A1 5/2007 Diaz et al.
2007/0127897 A1 6/2007 John et al.
2007/0131428 A1 6/2007 den Boestert et al.
2007/0133959 A1 6/2007 Vinegar et al.
2007/0133960 A1 6/2007 Vinegar et al.
2007/0137856 A1 6/2007 McKinzie et al.
2007/0137857 A1 6/2007 Vinegar et al.
2007/0144732 A1 6/2007 Kim et al.
2007/0193743 A1 8/2007 Harris et al.
2007/0246994 A1 10/2007 Kaminsky et al.
2008/0006410 A1 1/2008 Looney et al.
2008/0017380 A1 1/2008 Vinegar et al.
2008/0017416 A1 1/2008 Watson et al.
2008/0035346 A1 2/2008 Nair et al.
2008/0035347 A1 2/2008 Brady et al.
2008/0035705 A1 2/2008 Menotti
2008/0038144 A1 2/2008 Maziasz et al.
2008/0048668 A1 2/2008 Mashikian
2008/0078551 A1 4/2008 De Vault et al.
2008/0078552 A1 4/2008 Donnelly et al.
2008/0128134 A1 6/2008 Mudunuri et al.
2008/0135253 A1 6/2008 Vinegar et al.
2008/0135254 A1 6/2008 Vinegar et al.
2008/0142216 A1 6/2008 Vinegar et al.
2008/0142217 A1 6/2008 Pieterson et al.
2008/0173442 A1 7/2008 Vinegar et al.
2008/0173444 A1 7/2008 Stone et al.
2008/0174115 A1 7/2008 Lambirth
2008/0185147 A1 8/2008 Vinegar et al.
2008/0217003 A1 9/2008 Kuhlman et al.
2008/0217016 A1 9/2008 Stegemeier et al.
2008/0217321 A1 9/2008 Vinegar et al.
2008/0236831 A1 10/2008 Hsu et al.
2008/0277113 A1 11/2008 Stegemeier et al.
2008/0283241 A1 11/2008 Kaminsky et al.
2009/0014180 A1 1/2009 Stegemeier et al.
2009/0014181 A1 1/2009 Vinegar et al.

(56) References Cited

U.S. PATENT DOCUMENTS

| | | | | |
|---|---|---|---|---|
| 2009/0038795 | A1 | 2/2009 | Kaminsky | |
| 2009/0071652 | A1 | 3/2009 | Vinegar et al. | |
| 2009/0078461 | A1 | 3/2009 | Mansure et al. | |
| 2009/0084547 | A1 | 4/2009 | Farmayan et al. | |
| 2009/0090158 | A1 | 4/2009 | Davidson et al. | |
| 2009/0090509 | A1 | 4/2009 | Vinegar et al. | |
| 2009/0095476 | A1* | 4/2009 | Nguyen et al. | 166/302 |
| 2009/0095477 | A1 | 4/2009 | Nguyen et al. | |
| 2009/0095478 | A1 | 4/2009 | Karanikas et al. | |
| 2009/0095479 | A1 | 4/2009 | Karanikas et al. | |
| 2009/0095480 | A1 | 4/2009 | Vinegar et al. | |
| 2009/0101346 | A1 | 4/2009 | Vinegar et al. | |
| 2009/0113995 | A1* | 5/2009 | Golding et al. | 73/40.7 |
| 2009/0120646 | A1 | 5/2009 | Kim et al. | |
| 2009/0126929 | A1 | 5/2009 | Vinegar | |
| 2009/0139716 | A1 | 6/2009 | Brock et al. | |
| 2009/0189617 | A1 | 7/2009 | Burns et al. | |
| 2009/0194269 | A1 | 8/2009 | Vinegar | |
| 2009/0194282 | A1 | 8/2009 | Beer et al. | |
| 2009/0194286 | A1* | 8/2009 | Mason | 166/302 |
| 2009/0194287 | A1 | 8/2009 | Nguyen et al. | |
| 2009/0194329 | A1 | 8/2009 | Guimerans et al. | |
| 2009/0194333 | A1 | 8/2009 | MacDonald | |
| 2009/0194524 | A1 | 8/2009 | Kim et al. | |
| 2009/0200022 | A1 | 8/2009 | Bravo et al. | |
| 2009/0200023 | A1 | 8/2009 | Costello et al. | |
| 2009/0200025 | A1 | 8/2009 | Bravo et al. | |
| 2009/0200031 | A1 | 8/2009 | Miller | |
| 2009/0200290 | A1 | 8/2009 | Cardinal et al. | |
| 2009/0200854 | A1 | 8/2009 | Vinegar | |
| 2009/0228222 | A1 | 9/2009 | Fantoni | |
| 2009/0260823 | A1 | 10/2009 | Prince-Wright et al. | |
| 2009/0260824 | A1 | 10/2009 | Burns et al. | |
| 2009/0272526 | A1 | 11/2009 | Burns et al. | |
| 2009/0272535 | A1 | 11/2009 | Burns et al. | |
| 2009/0272536 | A1 | 11/2009 | Burns et al. | |
| 2009/0272578 | A1 | 11/2009 | McDonald | |
| 2009/0321417 | A1 | 12/2009 | Burns et al. | |
| 2010/0071903 | A1 | 3/2010 | Prince-Wright et al. | |
| 2010/0071904 | A1 | 3/2010 | Burns et al. | |
| 2010/0089584 | A1 | 4/2010 | Burns | |
| 2010/0089586 | A1 | 4/2010 | Stanecki | |
| 2010/0096137 | A1* | 4/2010 | Nguyen et al. | 166/302 |
| 2010/0101783 | A1 | 4/2010 | Vinegar et al. | |
| 2010/0101784 | A1 | 4/2010 | Vinegar et al. | |
| 2010/0101794 | A1 | 4/2010 | Ryan | |
| 2010/0108310 | A1 | 5/2010 | Fowler et al. | |
| 2010/0108379 | A1 | 5/2010 | Edbury et al. | |
| 2010/0147521 | A1 | 6/2010 | Xie et al. | |
| 2010/0147522 | A1 | 6/2010 | Xie et al. | |
| 2010/0155070 | A1 | 6/2010 | Roes et al. | |
| 2010/0206570 | A1 | 8/2010 | Ocampos et al. | |
| 2010/0258265 | A1* | 10/2010 | Karanikas et al. | 165/45 |
| 2010/0258290 | A1 | 10/2010 | Bass | |
| 2010/0258291 | A1 | 10/2010 | de St. Remey et al. | |
| 2010/0258309 | A1 | 10/2010 | Ayodele et al. | |
| 2010/0288497 | A1 | 11/2010 | Burnham et al. | |
| 2011/0042085 | A1 | 2/2011 | Diehl | |
| 2011/0132600 | A1 | 6/2011 | Kaminsky et al. | |
| 2011/0247806 | A1 | 10/2011 | Harris et al. | |
| 2011/0247807 | A1 | 10/2011 | Harris et al. | |
| 2011/0247811 | A1 | 10/2011 | Beer | |
| 2011/0247819 | A1 | 10/2011 | Nguyen et al. | |
| 2011/0247820 | A1 | 10/2011 | Marino et al. | |
| 2012/0018421 | A1 | 1/2012 | Parman et al. | |
| 2013/0087337 | A1 | 4/2013 | Gonzalez et al. | |

FOREIGN PATENT DOCUMENTS

| | | |
|---|---|---|
| CA | 1196594 | 11/1985 |
| CA | 1253555 | 5/1989 |
| CA | 1288043 | 8/1991 |
| CA | 2015460 | 10/1991 |
| EP | 107927 | 5/1984 |
| EP | 130671 | 9/1985 |
| EP | 0940558 | 9/1999 |
| GB | 156396 | 1/1921 |
| GB | 674082 | 7/1950 |
| GB | 1010023 | 11/1965 |
| GB | 1204405 | 9/1970 |
| GB | 1454324 | 11/1976 |
| SE | 121737 | 5/1948 |
| SE | 123136 | 11/1948 |
| SE | 123137 | 11/1948 |
| SE | 123138 | 11/1948 |
| SE | 126674 | 11/1949 |
| SU | 1836876 | 12/1990 |
| WO | 9506093 | 3/1995 |
| WO | 9723924 | 7/1997 |
| WO | 9901640 | 1/1999 |
| WO | 0019061 | 4/2000 |
| WO | 0181505 | 11/2001 |
| WO | 2008048448 | 4/2008 |

OTHER PUBLICATIONS

Moreno et al., Sandia National Laboratories, "Methods and Energy Sources for Heating Subsurface Geological Formations, Task 1: Heat Delivery Systems", Nov. 20, 2002, 166 pages.

Burnham, "Reaction Kinetics Between C02 and Oil Shale Char", Mar. 22, 1978, 18 pages.

Burnham, "Reaction Kinetics Between C02 and Oil Shale Residual Carbon. I. Effect of Heating Rate on Reactivity", Jul. 11, 1978, 21 pages.

Burnham et al., "High-Pressure Pyrolysis of Colorado Oil Shale", Oct. 1982, 23 pages.

Burnham et al., "A Possible Mechanism of Alkene/Alkane Production in Oil Shale Retorting", Nov. 26, 1980, 20 pages.

Camp, "Enthalpy Relations for Eastern Oil Shale", Nov. 1987, 13 pages.

Coburn et al., "Oil Shale Retorting: Part 3 A Correlation of Shale Oil 1-Alkene/n-Alkane Ratios With Yield", Aug. 1, 1977, 18 pages.

Cook et al., "The Composition of Green River Shale Oils", 1968, 12 pages.

Cummins et al., "Thermal Degradation of Green River Kerogen at 150o to 350o C; Rate of Production Formation", 1972, 18 pages.

Larue et al., "Retorting of Green River Oil Shale Under High-Pressure Hydrogen Atmospheres", Jun., 1977, 38 pages.

Lewis et al., "Retorting and Combustion Processes in Surface Oil-Shale Retorts", May 2, 1980, 12 pages.

Lewis et al., "Oil Shale Retorting Processes: A Technical Overview", Mar. 1984, 18 pages.

Oh et al., "Study of Gas Evolution During Oil Shale Pyrolysis by TQMS", Feb. 1988, 10 pages.

Piwinskii et al., "The Permittivity and Electrical Conductivity of Oil Shale", Apr. 28, 1975, 12 pages.

Raley et al., "Oil Degradation During Oil Shale Retorting", May 24, 1976, 14 pages.

Reynolds et al., "Kinetic Analysis of California Oil Shale by Programmed Temperature Micropyrolysis", Dec. 9, 1991, 13 pages.

Reynolds et al., "Analysis of Oil Shale and Petroleum Source Rock Pyrolysis by Triple Quadrupole Mass Spectrometry: Comparisons of Gas Evolution at the Heating Rate of 10oC/Min.", Oct. 5, 1990, 57 pages.

Richardson et al., "Fluidized-Bed Pyrolysis of Oil Shale", Oct. 1981, 27 pages.

Richardson et al., "Retorting Kinetics for Oil Shale From Fluidized-Bed Pyrolysis", Dec. 1981, 30 pages.

Rothman, "Recent Experimental Developments in Retorting Oil Shale at the Lawrence Livermore Laboratory", Aug. 1978, 32 pages.

Sandholtz et al., "The Lawrence Livermore Laboratory Oil Shale Retorts", Sep. 18, 1978, 29 pages.

Sandholtz et al., "Operating Laboratory Oil Shale Retorts in an In-Situ Mode", Aug. 18, 1977, 16 pages.

Sandholtz, "Some Relationships of Thermal Effects to Rubble-Bed Structure and Gas-Flow Patterns in Oil Shale Retorts", Mar. 1980, 19 pages.

(56) References Cited

OTHER PUBLICATIONS

Singleton et al., "Assay Products from Green River Oil Shale", Feb. 18, 1986, 213 pages.
Singleton et al., "Biomarkers in Oil Shale: Occurrence and Applications", Oct. 1982, 28 pages.
Singleton et al., "Occurrence of Biomarkers in Green River Shale Oil", Mar. 1983, 29 pages.
Sisemore, "An Instrumentation Proposal for Retorts in the Demonstration Phase of Oil Shale Development", Apr. 19, 1977, 34 pages.
Burnham et al., "Pyrolysis Kinetics for Green River Oil Shale From the Saline Zone", Feb. 1982, 33 pages.
Taylor et al., "S02 Emissions from the Oxidation of Retorted Oil Shale", Nov. 1981, 9 pages.
Taylor et al., "Nitric Oxide (NO) Reduction by Retorted Oil Shale", Oct. 1983, 16 pages.
Wallman, "Coproduction of Oil and Electric Power from Colorado Oil Shale", Sep. 24, 1991, 20 pages.
Ward et al., "13C NMR Studies of Shale Oil", Aug. 1982, 22 pages.
Ward et al., "Identification by 13C NMR of Carbon Types in Shale Oil and their Relationship to Pyrolysis Conditions", Sep. 1983, 27 pages.
Wise et al., "A Laboratory Study of Green River Oil Shale Retorting Under Pressure in a Nitrogen Atmosphere", Sep. 1976, 24 pages.
Wong et al., "Quantitative Analysis and Evolution of Sulfur-Containing Gases from Oil Shale Pyrolysis by Triple Quadrupole Mass Spectrometry", Nov. 1983, 34 pages.
Wong et al., "Quantitative Analysis & Kinetics of Trace Sulfur Gas Species from Oil Shale Pyrolysis by Triple Quadrupole Mass Spectrometry (TQMS)", Jul. 5-7, 1983, 34 pages.
Wong et al., "Application of Self-Adaptive Detector System on a Triple Quadrupole MS/MS to High Explosives and Sulfur-Containing Pyrolysis Gases from Oil Shale", Oct. 1983, 17 pages.
Wong et al., "An Evaluation of Triple Quadrupole MS/MS for On-Line Gas Analyses of Trace Sulfur Compounds from Oil Shale Processing", Jan. 1985, 30 pages.
Burnham et al., "General Model of Oil Shale Pyrolysis", Nov. 1983, 22 pages.
"Proposed Field Test of the Lins Method Thermal Oil Recovery Process", in Athabasca, McMurray Tar Sands, McMurray, Alberta, Husky Oil Company cody, Wyoming, circa 1960.
Berchenko et al., "In-Situ Measurement of Some Thermoporoelastic Parameters of a Granite", Poromechanics, A Tribute to Maurice Biot, 1998, 6 pages.
Collin et al., "Tar and Pitch", Ullmann's Encyclopedia of Industrial Chemistry, vol. A 26, 1995, 39 pages.
Hyne, "Geology for Petroleum Exploration, Drilling, and Production", McGraw-Hill Book Company, 1984, 2 pages.
Burnham, "Oil Shale Retorting; Dependence of timing and composition on temperature and heating rate", Jan. 27, 1995, 25 pages.
Campbell et al., "Kinetics of oil generation from Colorado Oil Shale", IPC Business Press, Fuel, 1978, 3 pages.
Bae, "Some Effects of Pressure on Oil-Shale Retorting", Society of Petroleum Engineers Journal, Sep. 1969, 7 pages.
"New in situ shale-oil recovery process uses hot natural gas", The Oil & Gas Journal, May 16, 1966, 1 page.
Bosch et al., "Evaluation of Downhole Electric Impedance Heating Systems for Paraffin Control in Oil Wells", Industry Applications Society 37th Annual Petroleum and Chemical Industry Conference, The Institute of Electrical and Electronics Engineers Inc., Sep. 1990, 4 pages.
Eastlund et al., "New System Stops Paraffin Build-up", Petroleum Engineer, Jan. 1989, 3 pages.
Campbell et al., "Oil Shale Retorting: Effects of Particle Size and Heating Rate on Oil Evolution and Intraparticle Oil Degradation", In Situ 2(1), 1978, 47 pages.
Dougan et al., "The Potential for in Situ Retorting of Oil Shale in the Piceance Creek Basin of Northwestern Colorado", Quarterly of the Colorado School of Mines, 16 pages, 1970.
Grant, "Retorting Oil Shale Underground-Problems & Possibilities", Qtly of Colorado School of Mines, 10 pages, 1960.
Hershkowitz et al., "Molecular Mechanism of Oil Shale Pyrolysis in Nitrogen and Hydrogen Atmospheres", Geochemistry and Chemistry of Oil Shales, American Chemical Society, May, 1983, 16 pages.
Hill et al., "The Characteristics of a Low Temperature in Situ Shale Oil", Quarterly of the Colorado School of Mines, 1967, 16 pages.
Hill et al., "Direct Production of a Low Pour Point High Gravity Shale Oil", I & EC Product Research and Development, 6(1), Mar. 1967, 8 pages.
Lundquist, "Refining of Swedish Shale Oil", 7 pages, 1951.
Kuhlman, "The Benefits of In Situ Upgrading Reactions to the Integrated Operations of the Orinoco Heavy-Oil Fields and Downstream Facilities", Society of Petroleum Engineers, Jun. 2000, 14 pages.
Raley, "Monitoring Oil Shale Retorts by Off-Gas Alkene/Alkane Ratios", Fuel, vol. 59, Jun. 1980, 6 pages.
Ljungstrom, "The Shale Oil Question, Old and New Viewpoints", A Lecture in the Engineering Science Academy, Feb. 23, 1950, published in Teknisk Trdskrift, Jan. 1951, 30 pages.
"Underground Shale Oil Pyrolysis According to the Ljungstroem Method", Svenska Skifferolje Aktiebolaget (Swedish Shale Oil Corp.), IVA, vol. 24, 1953, No. 3, 13 pages.
Sresty et al., "Kinetics of Low-Temperature Pyrolysis of Oil Shale by the IITRI RF Process", 15th Oil Shale Symposium, Colorado School of Mines, Apr. 1982, 13 pages.
Thorne, "Bureau of Mines Oil-Shale Research", Quarterly of the Colorado School of Mines, 14 pages, 1964.
Weitkamp et al., "Application of a Microretort to Problems in Shale Pyrolysis", Ind. Eng. Chern. Process Des. Develop, vol. 9, No. 3, 1970, 11 pages.
Yen et al., "Oil Shale", Developments in Petroleum Science 5, 1976, 6 pages.
Cook et al., "The Composition of Green River Shale Oils", United Nations Symposium on the Development and Utilization of Oil Shale Resources, 1968, 12 pages.
Burnham et al., "High-Pressure Pyrolysis of Green River Oil Shale", Geochemistry and Chemistry of Oil Shales, American Chemical Society, 1983, 17 pages.
Tissot et al., "Geochemistry and Pyrolysis of Oil Shales", Geochemistry and Chemistry of Oil Shales, American Chemical Society, 1983, 11 pages.
Burnham et al., "A Possible Mechanism of Alkene/Alkane Production", Oil Shale, Tar Sands, and Related Materials, American Chemical Society, 1981, 8 pages.
Salomonsson, "The Ljungstroem In-Situ Method for Shale Oil Recovery", Oil Shale and Cannel Coal, vol. 2, Proceedings of the Second Oil Shale and Cannel Coal Conference, Institute of Petroleum, 1951, London, 21 pages.
Dinneen et al., "Developments in Technology for Green River Oil Shale", United Nations Symposium on the Development and Utilization of Oil Shale Resources, Laramie Petroleum Research Center, Bureau of Mines, 1968, 11 pages.
Glass, "The Thermal and Structural Properties of a Hanna Basin Coal", Transactions of the ASME, vol. 106, Jun. 1984, 6 pages.
Burnham et al., "On the Mechanism of Kerogen Pyrolysis", Jan. 10, 1984, 17 pages.
Burnham et al., "Comparison of Methods for Measuring Kerogen Pyrolysis Rates and Filling Kinetic Parameters", Mar. 23, 1987, 29 pages.
Burnham et al., "Further Comparison of Methods for Measuring Kerogen Pyrolysis Rates and Fitting Kinetic Parameters", Sep. 1987, 15 pages.
Bissell et al., "Shale Oil Cracking Kinetics and Diagnostics", Nov. 1983, 28 pages.
Braun, "Mathematical Modeling of Modified In Situ and Aboveground Oil Shale Retorting", Jan. 1981, 45 pages.
Braun et al., "Progress Report on Computer Model for in Situ Oil Shale Retorting", Jul. 14, 1977, 34 pages.
Burnham, "Chemical Kinetics and Oil Shale Process Design", Jul. 1993, 14 pages.
Burnham, "Reaction Kinetics and Diagnostics for Oil Shale Retorting", Oct. 19, 1981, 32 pages.
Burnham, "Reaction Kinetics Between Steam and Oil Shale Char", Oct. 1978, 8 pages.

(56) References Cited

OTHER PUBLICATIONS

Burnham et al., "General Kinetic Model of Oil Shale Pyrolysis", Dec. 1984, 25 pages.
Chinese Office Action for Application 200980140452.7, mailed Dec. 13, 2012.
Non-final Office Action, U.S. Appl. No. 12/901,257, mailed Dec. 22, 2011, 9 pages.
International Search Report and Written Opinion, International Application No. PCT/US2011/031553, mailed Jun. 8, 2011, 6 pages.
Rangel-German et al., "Electrical-Heating-Assisted Recovery for Heavy Oil", 43 pages, Feb. 1, 2013, Henrique Oliveira.
Kovscek, "Reservoir Engineering analysis of Novel Thermal Oil Recovery Techniques applicable to Alaskan North Slope Heavy Oils", 6 pages, circa 2004.
Bosch et al. "Evaluation of Downhole Electric Impedance Heating Systems for Paraffin Control in Oil Wells," IEEE Transactions on Industrial Applications, Jan.-Feb. 1992, vol. 28, No. 1, 6 pages.
McGee et al., "Electrical Heating with Horizontal Wells, The Heat Transfer Problem", International Conference on Horizontal Well Technology, Calgary, Alberta, Canada, Nov. 18-20, 1996, 14 pages.
Hill et al., "The Characteristics of a Low Temperature in Situ Shale Oil" American Institute of Mining, Metallurgical & Petroleum Engineers, Feb. 19-23, 1967, 15 pages.
Rouffignac, "In Situ Resistive Heating of Oil Shale for Oil Production—A Summary of the Swedish Data" 4 pages, published prior to Oct. 2001.
SSAB report, "A Brief Description of the Ljungstrom Method for Shale Oil Production," 1950, 13 pages.
Salomonsson, SSAB report, "The Lungstrom In Situ-Method for Shale Oil Recovery", 1950, 30 pages.
"Swedish shale oil; Production methods in Sweden," Organisation for European Economic Co-operation, 1952, Paris, France, 43 pages.
SSAB report, "Kvarn Torp", 1958, 35 pages.
SSAB report, "Kvarn Torp"', 1951, 34 pages.
SSAB report, "Summary study of the shale oil works at Narkes Kvarntorp", 15 pages, published prior to Oct. 2001.
Vogel et al., "An Analog Computer for Studying Heat Transfer during a Thermal Recovery Process," AIME Petroleum Transactions, vol. 204, 1955, 8 pages.
SAAB report, "The Swedish Shale Oil Industry," 1948, 8 pages.
Gejrot et al., "The Shale Oil Industry in Sweden," Carlo Colombo Publishers-Rome, Proceedings of the Fourth World Petroleum Congress, Jun. 6-15, 1955, Rome, Italy, 8 pages.
Hedback, "The Swedish Shale as Raw Material for Production of Power, Oil and Gas", XIth Sectional Meeting World Power Conference, 1957, 10 pages.
SAAB, "Santa Cruz, California, Field Test of the Lins Method for the Recovery of Oil from Tar Sand", 1955, vol. 1, 145 pages.
SAAB, "Santa Cruz, California, Field Test of the Lins Method for the Recovery of Oil from Tar Sand-Figures", 1955 vol. 2, 161 pages.
Helander, "Field Test of Carbon Steel Burner Casings for the Lins Method of Oil Recovery", Santa Cruz, California, Oct. 9, 1959, 38 pages.
Helander et al., "Field Test of Fluidized Bed Burners for the Lins Method of Oil Recovery", Oct. 5, 1959, Santa Cruz, California, 86 pages.
"Burner Test Results-English", 1959-1960, 148 pages.

* cited by examiner

LEAK DETECTION IN CIRCULATED FLUID SYSTEMS FOR HEATING SUBSURFACE FORMATIONS

PRIORITY CLAIM

This patent application is a continuation of U.S. patent application Ser. No. 14/160,031 entitled "LEAK DETECTION IN CIRCULATED FLUID SYSTEMS FOR HEATING SUBSURFACE FORMATIONS" to Nguyen filed on Apr. 8, 2011, which is a divisional of U.S. patent application Ser. No. 13/083,246 (now U.S. Pat. No. 8,631,866 issued on Jan. 21, 2014) entitled "LEAK DETECTION IN CIRCULATED FLUID SYSTEMS FOR HEATING SUBSURFACE FORMATIONS" to Nguyen filed on Apr. 8, 2011, which claims priority to U.S. Provisional Patent No. 61/322,643 entitled "CIRCULATED FLUID SYSTEMS FOR HEATING SUBSURFACE FORMATIONS" to Nguyen et al. filed on Apr. 9, 2010; U.S. Provisional Patent No. 61/322,513 entitled "TREATMENT METHODOLOGIES FOR SUBSURFACE HYDROCARBON CONTAINING FORMATIONS" to Bass et al. filed on Apr. 9, 2010; and International Patent Application No. PCT/US11/31553 entitled "LEAK DETECTION IN CIRCULATED FLUID SYSTEMS FOR HEATING SUBSURFACE FORMATIONS" to Nguyen filed on Apr. 7, 2011, all of which are incorporated by reference in their entirety.

RELATED PATENTS

This patent application incorporates by reference in its entirety each of U.S. Pat. No. 6,688,387 to Wellington et al.; U.S. Pat. No. 6,991,036 to Sumnu-Dindoruk et al.; U.S. Pat. No. 6,698,515 to Karanikas et al.; U.S. Pat. No. 6,880,633 to Wellington et al.; U.S. Pat. No. 6,782,947 to de Rouffignac et al.; U.S. Pat. No. 6,991,045 to Vinegar et al.; U.S. Pat. No. 7,073,578 to Vinegar et al.; U.S. Pat. No. 7,121,342 to Vinegar et al.; U.S. Pat. No. 7,320,364 to Fairbanks; U.S. Pat. No. 7,527,094 to McKinzie et al.; U.S. Pat. No. 7,584,789 to Mo et al.; U.S. Pat. No. 7,533,719 to Hinson et al.; U.S. Pat. No. 7,562,707 to Miller; U.S. Pat. No. 7,841,408 to Vinegar et al.; and U.S. Pat. No. 7,866,388 to Bravo; U.S. Patent Application Publication Nos. 2010-0071903 to Prince-Wright et al. and 2010-0096137 to Nguyen et al.

BACKGROUND

1. Field of the Invention

The present invention relates generally to methods and systems for production of hydrocarbons, hydrogen, and/or other products from various subsurface formations such as hydrocarbon containing formations.

2. Description of Related Art

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations. Chemical and/or physical properties of hydrocarbon material in a subterranean formation may need to be changed to allow hydrocarbon material to be more easily removed from the subterranean formation. The chemical and physical changes may include in situ reactions that produce removable fluids, composition changes, solubility changes, density changes, phase changes, and/or viscosity changes of the hydrocarbon material in the formation. A fluid may be, but is not limited to, a gas, a liquid, an emulsion, a slurry, and/or a stream of solid particles that has flow characteristics similar to liquid flow.

U.S. Pat. No. 7,575,052 to Sandberg et al., which is incorporated by reference as if fully set forth herein, describes an in situ heat treatment process that utilizes a circulation system to heat one or more treatment areas. The circulation system may use a heated liquid heat transfer fluid that passes through piping in the formation to transfer heat to the formation.

U.S. Patent Application Publication No. 2008-0135254 to Vinegar et al., which is incorporated by reference as if fully set forth herein, describes systems and methods for an in situ heat treatment process that utilizes a circulation system to heat one or more treatment areas. The circulation system uses a heated liquid heat transfer fluid that passes through piping in the formation to transfer heat to the formation. In some embodiments, the piping is positioned in at least two wellbores.

U.S. Patent Application Publication No. 2009-0095476 to Nguyen et al., which is incorporated by reference as if fully set forth herein, describes a heating system for a subsurface formation includes a conduit located in an opening in the subsurface formation. An insulated conductor is located in the conduit. A material is in the conduit between a portion of the insulated conductor and a portion of the conduit. The material may be a salt. The material is a fluid at operating temperature of the heating system. Heat transfers from the insulated conductor to the fluid, from the fluid to the conduit, and from the conduit to the subsurface formation.

There has been a significant amount of effort to develop methods and systems to economically produce hydrocarbons, hydrogen, and/or other products from hydrocarbon containing formations. At present, however, there are still many hydrocarbon containing formations from which hydrocarbons, hydrogen, and/or other products cannot be economically produced. There is also a need for improved methods and systems that reduce energy costs for treating the formation, reduce emissions from the treatment process, facilitate heating system installation, and/or reduce heat loss to the overburden as compared to hydrocarbon recovery processes that utilize surface based equipment.

SUMMARY

Embodiments described herein generally relate to systems, methods, and heaters for treating a subsurface formation. Embodiments described herein also generally relate to heaters that have novel components therein. Such heaters can be obtained by using the systems and methods described herein.

In certain embodiments, the invention provides one or more systems, methods, and/or heaters. In some embodiments, the systems, methods, and/or heaters are used for treating a subsurface formation.

In certain embodiments, a method of treating a subsurface formation, includes: circulating at least one molten salt through piping located in the formation to heat at least a portion of the formation and heat at least some hydrocarbons in the formation to at least a mobilization temperature of the hydrocarbons; providing an oxidizing fluid to at least a portion of the piping; and oxidizing coke formed in the piping.

In certain embodiments, a method of treating a subsurface formation, includes circulating at least one molten salt through piping located in the formation to heat at least a portion of the formation and heat at least some hydrocarbons in the formation to at least a mobilization temperature of the hydrocarbons; and locating a liner in and/or around at least a portion of the piping to inhibit formation fluids from entering the piping and contacting the molten salt.

In certain embodiments, a method of treating a subsurface formation, includes: circulating at least one molten salt through at least one conduit of a conduit-in-conduit heater located in the formation to heat at least some hydrocarbons in the formation to at least a mobilization temperature of the hydrocarbons; producing at least some of the hydrocarbons from the formation; assessing an electrical resistance of at least one of the conduits of the conduit-in-conduit heater; and assessing a presence of a leak in at least one of the conduits based on the assessed resistance.

In certain embodiments, a method of treating a subsurface formation, includes: circulating at least one molten salt through at least one conduit of a conduit-in-conduit heater located in the formation to heat at least some hydrocarbons in the formation to at least a mobilization temperature of the hydrocarbons; producing at least some of the hydrocarbons from the formation; circulating an inert gas with the molten salt; and assessing a presence of a leak in at least one of the conduits by assessing a presence of the inert gas inside the walls of at least one of the conduits.

In certain embodiments, a method of treating a subsurface formation, includes: circulating at least one molten salt through piping in the formation to heat at least some hydrocarbons in the formation to at least a mobilization temperature of the hydrocarbons; producing at least some of the hydrocarbons from the formation; terminating circulation of the molten salt in the piping after a selected amount of hydrocarbons have been produced from the formation; and providing a compressed gas into the piping to remove molten salt remaining in the piping.

In certain embodiments, a method of heating a subsurface formation, includes: circulating a heated heat transfer fluid comprising a carbonate molten salt through piping positioned in at least two of a plurality of wellbores using a fluid circulation system, wherein the plurality of wellbores are positioned in a formation; and heating at least a portion of the formation.

In certain embodiments, a method for treating a hydrocarbon containing formation, includes: injecting a composition comprising solid salts in a section of the formation; providing heat from one or more heaters to the portion of the formation to heat the composition to about or above a melting point of the solid salts in the composition; and melting at least a portion of the solid salts to form a molten salt and create fractures in the section.

In further embodiments, features from specific embodiments may be combined with features from other embodiments. For example, features from one embodiment may be combined with features from any of the other embodiments.

In further embodiments, treating a subsurface formation is performed using any of the methods, systems, power supplies, or heaters described herein.

In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
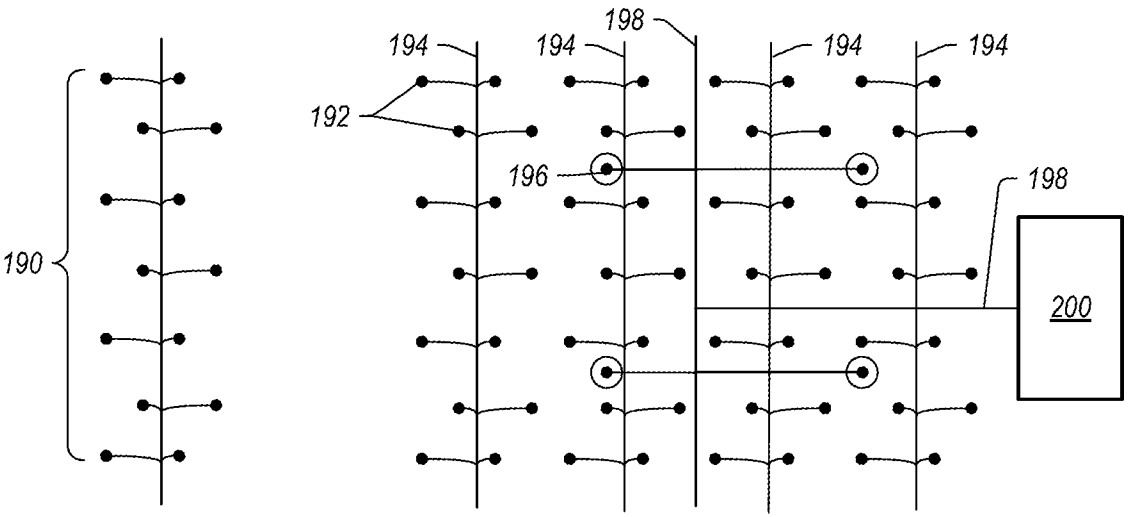
FIG. 1 shows a schematic view of an embodiment of a portion of an in situ heat treatment system for treating a hydrocarbon containing formation.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

The following description generally relates to systems and methods for treating hydrocarbons in the formations. Such formations may be treated to yield hydrocarbon products, hydrogen, and other products.

"API gravity" refers to API gravity at 15.5° C. (60° F.). API gravity is as determined by ASTM Method D6822 or ASTM Method D1298.

"ASTM" refers to American Standard Testing and Materials.

In the context of reduced heat output heating systems, apparatus, and methods, the term "automatically" means such systems, apparatus, and methods function in a certain way without the use of external control (for example, external controllers such as a controller with a temperature sensor and a feedback loop, PID controller, or predictive controller).

"Asphalt/bitumen" refers to a semi-solid, viscous material soluble in carbon disulfide. Asphalt/bitumen may be obtained from refining operations or produced from subsurface formations.

"Carbon number" refers to the number of carbon atoms in a molecule. A hydrocarbon fluid may include various hydrocarbons with different carbon numbers. The hydrocarbon fluid may be described by a carbon number distribution. Carbon numbers and/or carbon number distributions may be determined by true boiling point distribution and/or gas-liquid chromatography.

"Condensable hydrocarbons" are hydrocarbons that condense at 25° C. and one atmosphere absolute pressure. Condensable hydrocarbons may include a mixture of hydrocarbons having carbon numbers greater than 4. "Non-condensable hydrocarbons" are hydrocarbons that do not condense at 25° C. and one atmosphere absolute pressure. Non-condensable hydrocarbons may include hydrocarbons having carbon numbers less than 5.

A "fluid" may be, but is not limited to, a gas, a liquid, an emulsion, a slurry, and/or a stream of solid particles that has flow characteristics similar to liquid flow.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate. In some embodiments of in situ heat treatment processes, the overburden and/or the underburden may include a hydrocarbon containing layer or hydrocarbon containing layers that are relatively impermeable and are not subjected to temperatures during in situ heat treatment processing that result in significant characteristic changes of the hydrocarbon containing layers of the overburden and/or the underburden. For example, the underburden may contain shale or mudstone, but the underburden is not allowed to heat to pyrolysis temperatures during the in situ heat treatment process. In some cases, the overburden and/or the underburden may be somewhat permeable.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation. "Produced fluids" refer to fluids removed from the formation.

A "heat source" is any system for providing heat to at least a portion of a formation substantially by conductive and/or radiative heat transfer. For example, a heat source may include electrically conducting materials and/or electric heaters such as an insulated conductor, an elongated member, and/or a conductor disposed in a conduit. A heat source may also include systems that generate heat by burning a fuel external to or in a formation. The systems may be surface burners, downhole gas burners, flameless distributed combustors, and natural distributed combustors. In some embodiments, heat provided to or generated in one or more heat sources may be supplied by other sources of energy. The other sources of energy may directly heat a formation, or the energy may be applied to a transfer medium that directly or indirectly heats the formation. It is to be understood that one or more heat sources that are applying heat to a formation may use different sources of energy. Thus, for example, for a given formation some heat sources may supply heat from electrically conducting materials, electric resistance heaters, some heat sources may provide heat from combustion, and some heat sources may provide heat from one or more other energy sources (for example, chemical reactions, solar energy, wind energy, biomass, or other sources of renewable energy). A chemical reaction may include an exothermic reaction (for example, an oxidation reaction). A heat source may also include an electrically conducting material and/or a heater that provides heat to a zone proximate and/or surrounding a heating location such as a heater well.

A "heater" is any system or heat source for generating heat in a well or a near wellbore region. Heaters may be, but are not limited to, electric heaters, burners, combustors that react with material in or produced from a formation, and/or combinations thereof.

"Heavy hydrocarbons" are viscous hydrocarbon fluids. Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20°. Heavy oil, for example, generally has an API gravity of about 10-20°, whereas tar generally has an API gravity below about 10°. The viscosity of heavy hydrocarbons is generally greater than about 100 centipoise at 15° C. Heavy hydrocarbons may include aromatics or other complex ring hydrocarbons.

Heavy hydrocarbons may be found in a relatively permeable formation. The relatively permeable formation may include heavy hydrocarbons entrained in, for example, sand or carbonate. "Relatively permeable" is defined, with respect to formations or portions thereof, as an average permeability of 10 millidarcy or more (for example, 10 or 100 millidarcy). "Relatively low permeability" is defined, with respect to formations or portions thereof, as an average permeability of less than about 10 millidarcy. One darcy is equal to about 0.99 square micrometers. An impermeable layer generally has a permeability of less than about 0.1 millidarcy.

Certain types of formations that include heavy hydrocarbons may also include, but are not limited to, natural mineral waxes, or natural asphaltites. "Natural mineral waxes" typically occur in substantially tubular veins that may be several meters wide, several kilometers long, and hundreds of meters deep. "Natural asphaltites" include solid hydrocarbons of an aromatic composition and typically occur in large veins. In situ recovery of hydrocarbons from formations such as natural mineral waxes and natural asphaltites may include melting to form liquid hydrocarbons and/or solution mining of hydrocarbons from the formations.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

An "in situ conversion process" refers to a process of heating a hydrocarbon containing formation from heat sources to raise the temperature of at least a portion of the formation above a pyrolysis temperature so that pyrolyzation fluid is produced in the formation.

An "in situ heat treatment process" refers to a process of heating a hydrocarbon containing formation with heat sources to raise the temperature of at least a portion of the formation above a temperature that results in mobilized fluid, visbreaking, and/or pyrolysis of hydrocarbon containing material so that mobilized fluids, visbroken fluids, and/or pyrolyzation fluids are produced in the formation.

"Insulated conductor" refers to any elongated material that is able to conduct electricity and that is covered, in whole or in part, by an electrically insulating material.

"Kerogen" is a solid, insoluble hydrocarbon that has been converted by natural degradation and that principally contains carbon, hydrogen, nitrogen, oxygen, and sulfur. Coal and oil shale are typical examples of materials that contain kerogen. "Bitumen" is a non-crystalline solid or viscous hydrocarbon material that is substantially soluble in carbon disulfide. "Oil" is a fluid containing a mixture of condensable hydrocarbons.

"Perforations" include openings, slits, apertures, or holes in a wall of a conduit, tubular, pipe or other flow pathway that allow flow into or out of the conduit, tubular, pipe or other flow pathway.

"Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis zone" refers to a volume of a formation (for example, a relatively permeable formation such as a tar sands formation) that is reacted or reacting to form a pyrolyzation fluid.

"Rich layers" in a hydrocarbon containing formation are relatively thin layers (typically about 0.2 m to about 0.5 m thick). Rich layers generally have a richness of about 0.150 L/kg or greater. Some rich layers have a richness of about 0.170 L/kg or greater, of about 0.190 L/kg or greater, or of about 0.210 L/kg or greater. Lean layers of the formation have a richness of about 0.100 L/kg or less and are generally thicker than rich layers. The richness and locations of layers are determined, for example, by coring and subsequent Fischer assay of the core, density or neutron logging, or other logging methods. Rich layers may have a lower initial thermal conductivity than other layers of the formation. Typically, rich layers have a thermal conductivity 1.5 times to 3 times lower than the thermal conductivity of lean layers. In addition, rich layers have a higher thermal expansion coefficient than lean layers of the formation.

"Superposition of heat" refers to providing heat from two or more heat sources to a selected section of a formation such that the temperature of the formation at least at one location between the heat sources is influenced by the heat sources.

"Synthesis gas" is a mixture including hydrogen and carbon monoxide. Additional components of synthesis gas may include water, carbon dioxide, nitrogen, methane, and other gases. Synthesis gas may be generated by a variety of processes and feedstocks. Synthesis gas may be used for synthesizing a wide range of compounds.

"Tar" is a viscous hydrocarbon that generally has a viscosity greater than about 10,000 centipoise at 15° C. The specific gravity of tar generally is greater than 1.000. Tar may have an API gravity less than 10°.

A "tar sands formation" is a formation in which hydrocarbons are predominantly present in the form of heavy hydrocarbons and/or tar entrained in a mineral grain framework or other host lithology (for example, sand or carbonate). Examples of tar sands formations include formations such as the Athabasca formation, the Grosmont formation, and the Peace River formation, all three in Alberta, Canada; and the Faja formation in the Orinoco belt in Venezuela.

"Temperature limited heater" generally refers to a heater that regulates heat output (for example, reduces heat output) above a specified temperature without the use of external controls such as temperature controllers, power regulators, rectifiers, or other devices. Temperature limited heaters may be AC (alternating current) or modulated (for example, "chopped") DC (direct current) powered electrical resistance heaters.

"Thickness" of a layer refers to the thickness of a cross section of the layer, wherein the cross section is normal to a face of the layer.

A "u-shaped wellbore" refers to a wellbore that extends from a first opening in the formation, through at least a portion of the formation, and out through a second opening in the formation. In this context, the wellbore may be only roughly in the shape of a "v" or "u", with the understanding that the "legs" of the "u" do not need to be parallel to each other, or perpendicular to the "bottom" of the "u" for the wellbore to be considered "u-shaped".

"Upgrade" refers to increasing the quality of hydrocarbons. For example, upgrading heavy hydrocarbons may result in an increase in the API gravity of the heavy hydrocarbons.

"Visbreaking" refers to the untangling of molecules in fluid during heat treatment and/or to the breaking of large molecules into smaller molecules during heat treatment, which results in a reduction of the viscosity of the fluid.

"Viscosity" refers to kinematic viscosity at 40° C. unless otherwise specified. Viscosity is as determined by ASTM Method D445.

"Wax" refers to a low melting organic mixture, or a compound of high molecular weight that is a solid at lower temperatures and a liquid at higher temperatures, and when in solid form can form a barrier to water. Examples of waxes include animal waxes, vegetable waxes, mineral waxes, petroleum waxes, and synthetic waxes.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

A formation may be treated in various ways to produce many different products. Different stages or processes may be used to treat the formation during an in situ heat treatment process. In some embodiments, one or more sections of the formation are solution mined to remove soluble minerals from the sections. Solution mining minerals may be performed before, during, and/or after the in situ heat treatment process. In some embodiments, the average temperature of one or more sections being solution mined may be maintained below about 120° C.

In some embodiments, one or more sections of the formation are heated to remove water from the sections and/or to remove methane and other volatile hydrocarbons from the sections. In some embodiments, the average temperature may be raised from ambient temperature to temperatures below about 220° C. during removal of water and volatile hydrocarbons.

In some embodiments, one or more sections of the formation are heated to temperatures that allow for movement and/or visbreaking of hydrocarbons in the formation. In some embodiments, the average temperature of one or more sections of the formation are raised to mobilization temperatures of hydrocarbons in the sections (for example, to temperatures ranging from 100° C. to 250° C., from 120° C. to 240° C., or from 150° C. to 230° C.).

In some embodiments, one or more sections are heated to temperatures that allow for pyrolysis reactions in the formation. In some embodiments, the average temperature of one or more sections of the formation may be raised to pyrolysis temperatures of hydrocarbons in the sections (for example, temperatures ranging from 230° C. to 900° C., from 240° C. to 400° C. or from 250° C. to 350° C.).

Heating the hydrocarbon containing formation with a plurality of heat sources may establish thermal gradients around the heat sources that raise the temperature of hydrocarbons in the formation to desired temperatures at desired heating rates. The rate of temperature increase through the mobilization temperature range and/or the pyrolysis temperature range for desired products may affect the quality and quantity of the formation fluids produced from the hydrocarbon containing formation. Slowly raising the temperature of the formation through the mobilization temperature range and/or pyrolysis temperature range may allow for the production of high quality, high API gravity hydrocarbons from the formation. Slowly raising the temperature of the formation through the mobilization temperature range and/or pyrolysis temperature range may allow for the removal of a large amount of the hydrocarbons present in the formation as hydrocarbon product.

In some in situ heat treatment embodiments, a portion of the formation is heated to a desired temperature instead of slowly raising the temperature through a temperature range. In some embodiments, the desired temperature is 300° C., 325° C., or 350° C. Other temperatures may be selected as the desired temperature.

Superposition of heat from heat sources allows the desired temperature to be relatively quickly and efficiently established in the formation. Energy input into the formation from the heat sources may be adjusted to maintain the temperature in the formation substantially at a desired temperature.

Mobilization and/or pyrolysis products may be produced from the formation through production wells. In some embodiments, the average temperature of one or more sections is raised to mobilization temperatures and hydrocarbons are produced from the production wells. The average temperature of one or more of the sections may be raised to pyrolysis temperatures after production due to mobilization decreases below a selected value. In some embodiments, the average temperature of one or more sections may be raised to pyrolysis temperatures without significant production before reaching pyrolysis temperatures. Formation fluids including pyrolysis products may be produced through the production wells.

In some embodiments, the average temperature of one or more sections may be raised to temperatures sufficient to allow synthesis gas production after mobilization and/or pyrolysis. In some embodiments, hydrocarbons may be raised to temperatures sufficient to allow synthesis gas production without significant production before reaching the temperatures sufficient to allow synthesis gas production. For example, synthesis gas may be produced in a temperature range from about 400° C. to about 1200° C., about 500° C. to about 1100° C., or about 550° C. to about 1000° C. A synthesis gas generating fluid (for example, steam and/or water) may be introduced into the sections to generate synthesis gas. Synthesis gas may be produced from production wells.

Solution mining, removal of volatile hydrocarbons and water, mobilizing hydrocarbons, pyrolyzing hydrocarbons, generating synthesis gas, and/or other processes may be performed during the in situ heat treatment process. In some embodiments, some processes may be performed after the in situ heat treatment process. Such processes may include, but are not limited to, recovering heat from treated sections, storing fluids (for example, water and/or hydrocarbons) in previously treated sections, and/or sequestering carbon dioxide in previously treated sections.

FIG. 1 depicts a schematic view of an embodiment of a portion of the in situ heat treatment system for treating the hydrocarbon containing formation. The in situ heat treatment system may include barrier wells 190. Barrier wells are used to form a barrier around a treatment area. The barrier inhibits fluid flow into and/or out of the treatment area. Barrier wells include, but are not limited to, dewatering wells, vacuum wells, capture wells, injection wells, grout wells, freeze wells, or combinations thereof. In some embodiments, barrier wells 190 are dewatering wells. Dewatering wells may remove liquid water and/or inhibit liquid water from entering a portion of the formation to be heated, or to the formation being heated. In the embodiment depicted in FIG. 1, the barrier wells 190 are shown extending only along one side of heat sources 192, but the barrier wells typically encircle all heat sources 192 used, or to be used, to heat a treatment area of the formation.

Heat sources 192 are placed in at least a portion of the formation. Heat sources 192 may include heaters such as insulated conductors, conductor-in-conduit heaters, surface burners, flameless distributed combustors, and/or natural distributed combustors. Heat sources 192 may also include other types of heaters. Heat sources 192 provide heat to at least a portion of the formation to heat hydrocarbons in the formation. Energy may be supplied to heat sources 192 through supply lines 194. Supply lines 194 may be structurally different depending on the type of heat source or heat sources used to heat the formation. Supply lines 194 for heat sources may transmit electricity for electric heaters, may transport fuel for combustors, or may transport heat exchange fluid that is circulated in the formation. In some embodiments, electricity for an in situ heat treatment process may be provided by a nuclear power plant or nuclear power plants. The use of nuclear power may allow for reduction or elimination of carbon dioxide emissions from the in situ heat treatment process.

When the formation is heated, the heat input into the formation may cause expansion of the formation and geomechanical motion. The heat sources may be turned on before, at the same time, or during a dewatering process. Computer simulations may model formation response to heating. The computer simulations may be used to develop a pattern and time sequence for activating heat sources in the formation so that geomechanical motion of the formation does not adversely affect the functionality of heat sources, production wells, and other equipment in the formation.

Heating the formation may cause an increase in permeability and/or porosity of the formation. Increases in permeability and/or porosity may result from a reduction of mass in the formation due to vaporization and removal of water, removal of hydrocarbons, and/or creation of fractures. Fluid may flow more easily in the heated portion of the formation because of the increased permeability and/or porosity of the formation. Fluid in the heated portion of the formation may move a considerable distance through the formation because of the increased permeability and/or porosity. The considerable distance may be over 1000 m depending on various factors, such as permeability of the formation, properties of the fluid, temperature of the formation, and pressure gradient allowing movement of the fluid. The ability of fluid to travel considerable distance in the formation allows production wells 196 to be spaced relatively far apart in the formation.

Production wells 196 are used to remove formation fluid from the formation. In some embodiments, production well 196 includes a heat source. The heat source in the production well may heat one or more portions of the formation at or near the production well. In some in situ heat treatment process embodiments, the amount of heat supplied to the formation from the production well per meter of the production well is less than the amount of heat applied to the formation from a heat source that heats the formation per meter of the heat source. Heat applied to the formation from the production well may increase formation permeability adjacent to the production well by vaporizing and removing liquid phase fluid adjacent to the production well and/or by increasing the permeability of the formation adjacent to the production well by formation of macro and/or micro fractures.

More than one heat source may be positioned in the production well. A heat source in a lower portion of the production well may be turned off when superposition of heat from adjacent heat sources heats the formation sufficiently to counteract benefits provided by heating the formation with the production well. In some embodiments, the heat source in an upper portion of the production well may remain on after the heat source in the lower portion of the production well is deactivated. The heat source in the upper portion of the well may inhibit condensation and reflux of formation fluid.

In some embodiments, the heat source in production well 196 allows for vapor phase removal of formation fluids from the formation. Providing heating at or through the production well may: (1) inhibit condensation and/or refluxing of production fluid when such production fluid is moving in the production well proximate the overburden, (2) increase heat input into the formation, (3) increase production rate from the production well as compared to a production well without a heat source, (4) inhibit condensation of high carbon number compounds ($C_6$ hydrocarbons and above) in the production well, and/or (5) increase formation permeability at or proximate the production well.

Subsurface pressure in the formation may correspond to the fluid pressure generated in the formation. As temperatures in the heated portion of the formation increase, the pressure in the heated portion may increase as a result of thermal expansion of in situ fluids, increased fluid generation and vaporization of water. Controlling rate of fluid removal from the formation may allow for control of pressure in the formation. Pressure in the formation may be determined at a number of different locations, such as near or at production wells, near or at heat sources, or at monitor wells.

In some hydrocarbon containing formations, production of hydrocarbons from the formation is inhibited until at least some hydrocarbons in the formation have been mobilized and/or pyrolyzed. Formation fluid may be produced from the formation when the formation fluid is of a selected quality. In some embodiments, the selected quality includes an API gravity of at least about 20°, 30°, or 40°. Inhibiting production until at least some hydrocarbons are mobilized and/or pyrolyzed may increase conversion of heavy hydrocarbons to light hydrocarbons. Inhibiting initial production may minimize the production of heavy hydrocarbons from the formation. Production of substantial amounts of heavy hydrocarbons may require expensive equipment and/or reduce the life of production equipment.

In some hydrocarbon containing formations, hydrocarbons in the formation may be heated to mobilization and/or pyrolysis temperatures before substantial permeability has been generated in the heated portion of the formation. An initial lack of permeability may inhibit the transport of generated fluids to production wells 196. During initial heating, fluid pressure in the formation may increase proximate heat sources 192. The increased fluid pressure may be released, monitored, altered, and/or controlled through one or more heat sources 192. For example, selected heat sources 192 or separate pressure relief wells may include pressure relief valves that allow for removal of some fluid from the formation.

In some embodiments, pressure generated by expansion of mobilized fluids, pyrolysis fluids or other fluids generated in the formation may be allowed to increase although an open path to production wells 196 or any other pressure sink may not yet exist in the formation. The fluid pressure may be allowed to increase towards a lithostatic pressure. Fractures in the hydrocarbon containing formation may form when the fluid approaches the lithostatic pressure. For example, fractures may form from heat sources 192 to production wells 196 in the heated portion of the formation. The generation of fractures in the heated portion may relieve some of the pressure in the portion. Pressure in the formation may have to be maintained below a selected pressure to inhibit unwanted production, fracturing of the overburden or underburden, and/or coking of hydrocarbons in the formation.

After mobilization and/or pyrolysis temperatures are reached and production from the formation is allowed, pressure in the formation may be varied to alter and/or control a composition of formation fluid produced, to control a percentage of condensable fluid as compared to non-condensable fluid in the formation fluid, and/or to control an API gravity of formation fluid being produced. For example, decreasing pressure may result in production of a larger condensable fluid component. The condensable fluid component may contain a larger percentage of olefins.

In some in situ heat treatment process embodiments, pressure in the formation may be maintained high enough to promote production of formation fluid with an API gravity of greater than 20°. Maintaining increased pressure in the formation may inhibit formation subsidence during in situ heat treatment. Maintaining increased pressure may reduce or eliminate the need to compress formation fluids at the surface to transport the fluids in collection conduits to treatment facilities.

Maintaining increased pressure in a heated portion of the formation may surprisingly allow for production of large quantities of hydrocarbons of increased quality and of relatively low molecular weight. Pressure may be maintained so that formation fluid produced has a minimal amount of compounds above a selected carbon number. The selected carbon number may be at most 25, at most 20, at most 12, or at most 8. Some high carbon number compounds may be entrained in vapor in the formation and may be removed from the formation with the vapor. Maintaining increased pressure in the formation may inhibit entrainment of high carbon number compounds and/or multi-ring hydrocarbon compounds in the vapor. High carbon number compounds and/or multi-ring hydrocarbon compounds may remain in a liquid phase in the formation for significant time periods. The significant time periods may provide sufficient time for the compounds to pyrolyze to form lower carbon number compounds.

Generation of relatively low molecular weight hydrocarbons is believed to be due, in part, to autogenous generation and reaction of hydrogen in a portion of the hydrocarbon containing formation. For example, maintaining an increased pressure may force hydrogen generated during pyrolysis into the liquid phase within the formation. Heating the portion to a temperature in a pyrolysis temperature range may pyrolyze hydrocarbons in the formation to generate liquid phase pyrolyzation fluids. The generated liquid phase pyrolyzation fluids components may include double bonds and/or radicals. Hydrogen ($H_2$) in the liquid phase may reduce double bonds of the generated pyrolyzation fluids, thereby reducing a potential for polymerization or formation of long chain compounds from the generated pyrolyzation fluids. In addition, $H_2$ may also neutralize radicals in the generated pyrolyzation fluids. $H_2$ in the liquid phase may inhibit the generated pyrolyzation fluids from reacting with each other and/or with other compounds in the formation.

Formation fluid produced from production wells 196 may be transported through collection piping 198 to treatment facilities 200. Formation fluids may also be produced from heat sources 192. For example, fluid may be produced from heat sources 192 to control pressure in the formation adjacent to the heat sources. Fluid produced from heat sources 192 may be transported through tubing or piping to collection piping 198 or the produced fluid may be transported through tubing or piping directly to treatment facilities 200. Treatment facilities 200 may include separation units, reaction units, upgrading units, fuel cells, turbines, storage vessels, and/or other systems and units for processing produced formation fluids. The treatment facilities may form transportation fuel from at least a portion of the hydrocarbons produced from the formation. In some embodiments, the transportation fuel may be jet fuel, such as JP-8.

In some in situ heat treatment process embodiments, a circulation system is used to heat the formation. Using the circulation system for in situ heat treatment of a hydrocarbon containing formation may reduce energy costs for treating the formation, reduce emissions from the treatment process, and/or facilitate heating system installation. In certain embodiments, the circulation system is a closed loop circulation system. The system may be used to heat hydrocarbons that are relatively deep in the ground and that are in formations that are relatively large in extent. In some embodiments, the hydrocarbons may be 100 m, 200 m, 300 m or more below the surface. The circulation system may also be used to heat hydrocarbons that are shallower in the ground. The hydrocarbons may be in formations that extend lengthwise up to 1000 m, 3000 m, 5000 m, or more. The heaters of the circulation system may be positioned relative to adjacent heaters such that superposition of heat between heaters of the circulation system allows the temperature of the formation to be raised at least above the boiling point of aqueous formation fluid in the formation.

In some embodiments, heaters are formed in the formation by drilling a first wellbore and then drilling a second wellbore that connects with the first wellbore. Piping may be positioned in the u-shaped wellbore to form u-shaped heaters. Heaters are connected to a heat transfer fluid circulation system by piping. In some embodiments, the heaters are positioned in triangular patterns. In some embodiments, other regular or irregular patterns are used. Production wells and/or injection wells may also be located in the formation. The production wells and/or the injection wells may have long, substantially horizontal sections similar to the heating portions of heaters, or the production wells and/or injection wells may be otherwise oriented (for example, the wells may be vertically oriented wells, or wells that include one or more slanted portions).

Figure 2:
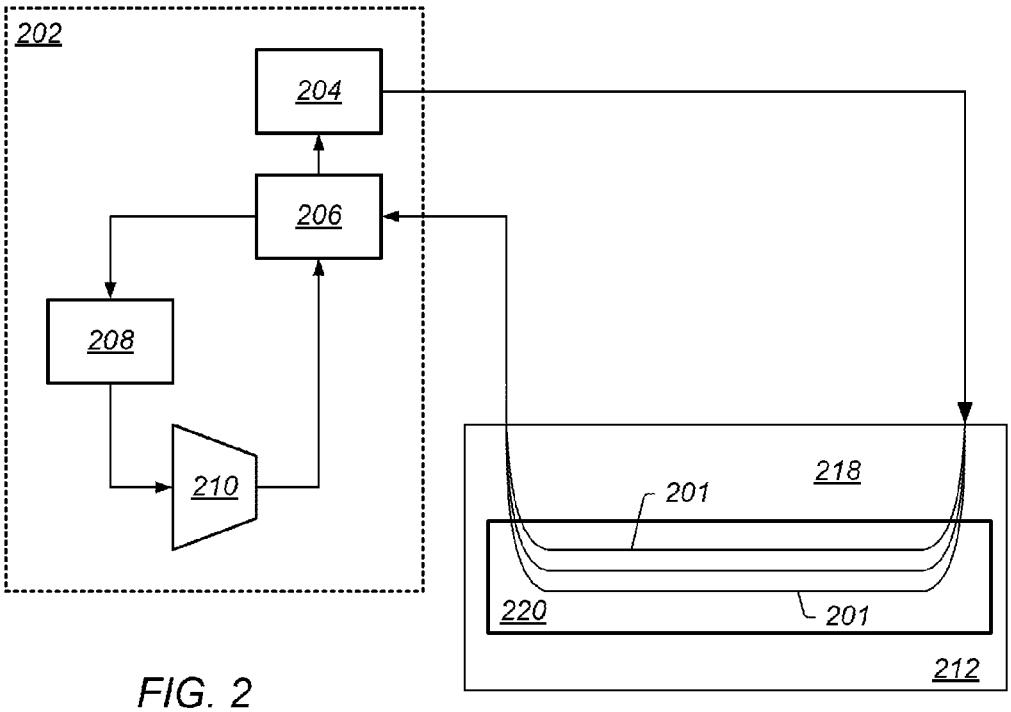
FIG. 2 depicts a schematic representation of an embodiment of a heat transfer fluid circulation system for heating a portion of a formation.

As depicted in FIG. 2, heat transfer fluid circulation system 202 may include heat supply 204, first heat exchanger 206, second heat exchanger 208, and fluid movers 210. Heat supply 204 heats the heat transfer fluid to a high temperature. Heat supply 204 may be a furnace, solar collector, chemical reactor, nuclear reactor, fuel cell, and/or other high temperature source able to supply heat to the heat transfer fluid. If the heat transfer fluid is a gas, fluid movers 210 may be compressors. If the heat transfer fluid is a liquid, fluid movers 210 may be pumps.

After exiting formation 212, the heat transfer fluid passes through first heat exchanger 206 and second heat exchanger 208 to fluid movers 210. First heat exchanger 206 transfers heat between heat transfer fluid exiting formation 212 and heat transfer fluid exiting fluid movers 210 to raise the temperature of the heat transfer fluid that enters heat supply 204 and reduce the temperature of the fluid exiting formation 212. Second heat exchanger 208 further reduces the temperature of the heat transfer fluid. In some embodiments, second heat exchanger 208 includes or is a storage tank for the heat transfer fluid. Heat transfer fluid passes from second heat exchanger 208 to fluid movers 210. Fluid movers 210 may be located before heat supply 204 so that the fluid movers do not have to operate at a high temperature.

In an embodiment, the heat transfer fluid is carbon dioxide. Heat supply 204 is a furnace that heats the heat transfer fluid to a temperature in a range from about 700° C. to about 920° C., from about 770° C. to about 870° C., or from about 800° C. to about 850° C. In an embodiment, heat supply 204 heats the heat transfer fluid to a temperature of about 820° C. The heat transfer fluid flows from heat supply 204 to heaters 201. Heat transfers from heaters 201 to formation 212 adjacent to the heaters. The temperature of the heat transfer fluid exiting formation 212 may be in a range from about 350° C. to about 580° C., from about 400° C. to about 530° C., or from about 450° C. to about 500° C. In an embodiment, the temperature of the heat transfer fluid exiting formation 212 is about 480° C. The metallurgy of the piping used to form heat transfer fluid circulation system 202 may be varied to significantly reduce costs of the piping. High temperature steel may be used from heat supply 204 to a point where the temperature is sufficiently low so that less expensive steel can be used from that point to first heat exchanger 206. Several different steel grades may be used to form the piping of heat transfer fluid circulation system 202.

Figure 3:
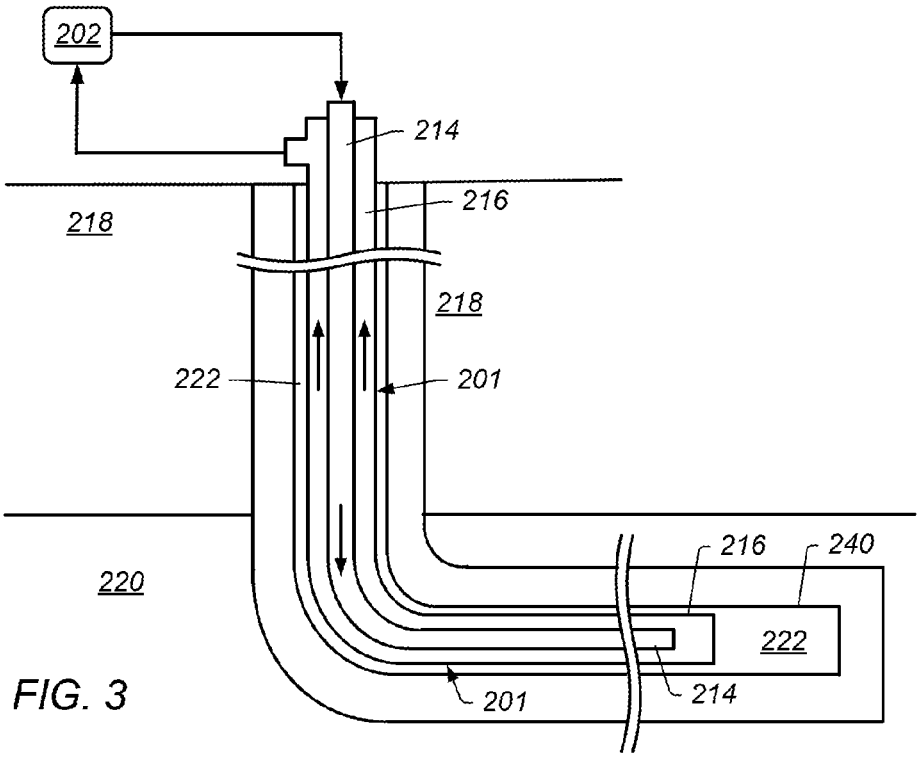
FIG. 3 depicts a schematic representation of an embodiment of an L-shaped heater for use with a heat transfer fluid circulation system for heating a portion of a formation.

In some embodiments, vertical, slanted, or L-shaped wellbores are used instead of u-shaped wellbores (for example, wellbores that have an entrance at a first location and an exit at another location). FIG. 3 depicts L-shaped heater 201. Heater 201 may be coupled to heat transfer fluid circulation system 202 and may include inlet conduit 214, and outlet conduit 216. Heat transfer fluid circulation system 202 may supply heat transfer fluid to multiple heaters. Heat transfer fluid from heat transfer fluid circulation system 202 may flow down inlet conduit 214 and back up outlet conduit 216. Inlet conduit 214 and outlet conduit 216 may be insulated through overburden 218. In some embodiments, inlet conduit 214 is insulated through overburden 218 and hydrocarbon containing layer 220 to inhibit undesired heat transfer between ingoing and outgoing heat transfer fluid.

In some embodiments, portions of wellbore 222 adjacent to overburden 218 are larger than portions of the wellbore adjacent to hydrocarbon containing layer 220. Having a larger opening adjacent to the overburden may allow for accommodation of insulation used to insulate inlet conduit 214 and/or outlet conduit 216. Some heat loss to the overburden from the return flow may not affect the efficiency significantly, especially when the heat transfer fluid is molten salt or another fluid that needs to be heated to remain a liquid. The heated overburden adjacent to heater 201 may maintain the heat transfer fluid as a liquid for a significant time should circulation of heat transfer fluid stop. Having some allowance for heat transfer to overburden 218 may eliminate the need for expensive insulation systems between outlet conduit 216 and the overburden. In some embodiments, insulative cement is used between overburden 218 and outlet conduit 216.

For vertical, slanted, or L-shaped heaters, the wellbores may be drilled longer than needed to accommodate non-energized heaters (for example, installed but inactive heaters). Thermal expansion of the heaters after energization may cause portions of the heaters to move into the extra length of the wellbores designed to accommodate the thermal expansion of the heaters. For L-shaped heaters, remaining drilling fluid and/or formation fluid in the wellbore may facilitate movement of the heater deeper into the wellbore as the heater expands during preheating and/or heating with heat transfer fluid.

For vertical or slanted wellbores, the wellbores may be drilled deeper than needed to accommodate the non-energized heaters. When the heater is preheated and/or heated with the heat transfer fluid, the heater may expand into the extra depth of the wellbore. In some embodiments, an expansion sleeve may be attached at the end of the heater to ensure available space for thermal expansion in case of unstable boreholes.

Figure 4:
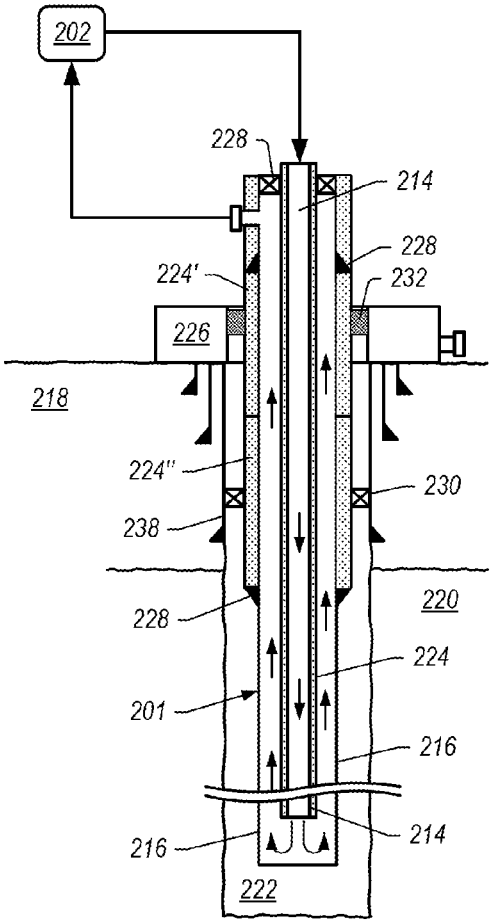
FIG. 4 depicts a schematic representation of an embodiment of a vertical heater for use with a heat transfer fluid circulation system for heating a portion of a formation where thermal expansion of the heater is accommodated below the surface.

FIG. 4 depicts a schematic representation of an embodiment of a portion of vertical heater 201. Heat transfer fluid circulation system 202 may provide heat transfer fluid to inlet conduit 214 of heater 201. Heat transfer fluid circulation system 202 may receive heat transfer fluid from outlet conduit heat 216. Inlet conduit 214 may be secured to outlet conduit 216 by welds 228. Inlet conduit 214 may include insulating sleeve 224. Insulating sleeve 224 may be formed of a number of sections. Each section of insulating sleeve 224 for inlet conduit 214 is able to accommodate the thermal expansion caused by the temperature difference between the temperature of the inlet conduit and the temperature outside the insulating sleeve. Change in length of inlet conduit 214 and insulation sleeve 224 due to thermal expansion is accommodated in outlet conduit 216.

Outlet conduit 216 may include insulating sleeve 224'. Insulating sleeve 224' may end near the boundary between overburden 218 and hydrocarbon layer 220. In some embodiments, insulating sleeve 224' is installed using a coiled tubing rig. An upper first portion of insulating sleeve 224' may be secured to outlet conduit 216 above or near wellhead 226 by weld 228. Heater 201 may be supported in wellhead 226 by a coupling between the outer support member of insulating sleeve 224' and the wellhead. The outer support member of insulating sleeve 224' may have sufficient strength to support heater 201.

In some embodiments, insulating sleeve 224' includes a second portion (insulating sleeve portion 224") that is separate and lower than the first portion of insulating sleeve 224'. Insulating sleeve portion 224" may be secured to outlet conduit 216 by welds 228 or other types of seals that can withstand high temperatures below packer 230. Welds 228 between insulating sleeve portion 224" and outlet conduit 216 may inhibit formation fluid from passing between the insulating sleeve and the outlet conduit. During heating, differential thermal expansion between the cooler outer surface and the hotter inner surface of insulating sleeve 224' may cause separation between the first portion of the insulating sleeve and the second portion of the insulating sleeve (insulating sleeve portion 224"). This separation may occur adjacent to the overburden portion of heater 201 above packer 230. Insulating cement between casing 238 and the formation may further inhibit heat loss to the formation and improve the overall energy efficiency of the system.

Packer 230 may be a polished bore receptacle. Packer 230 may be fixed to casing 238 of wellbore 222. In some embodiments, packer 230 is 1000 m or more below the surface. Packer 230 may be located at a depth above 1000 m, if desired. Packer 230 may inhibit formation fluid from flowing from the heated portion of the formation up the wellbore to wellhead 226. Packer 230 may allow movement of insulating sleeve portion 224" downwards to accommodate thermal expansion of heater 201. In some embodiments, wellhead 226 includes fixed seal 232. Fixed seal 232 may be a second seal that inhibits formation fluid from reaching the surface through wellbore 222 of heater 201.

Figure 5:
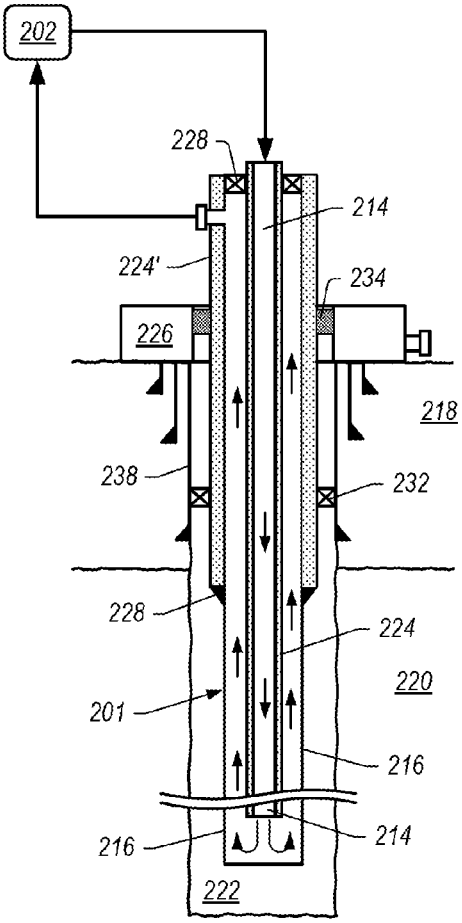
FIG. 5 depicts a schematic representation of another embodiment of a vertical heater for use with a heat transfer fluid circulation system for heating a portion of a formation where thermal expansion of the heater is accommodated above and below the surface.

FIG. 5 depicts a schematic representation of another embodiment of a portion of vertical heater 201 in wellbore 222. The embodiment depicted in FIG. 5 is similar to the embodiment depicted in FIG. 4, but fixed seal 232 is located adjacent to overburden 218, and sliding seal 234 is located in wellhead 226. The portion of insulating sleeve 224' from fixed seal 232 to wellhead 226 is able to expand upward out of the wellhead to accommodate thermal expansion. The portion of heater located below fixed seal 232 is able to expand into the excess length of wellbore 222 to accommodate thermal expansion.

In some embodiments, the heater includes a flow switcher. The flow switcher may allow the heat transfer fluid from the circulation system to flow down through the overburden in the inlet conduit of the heater. The return flow from the heater may flow upwards through the annular region between the inlet conduit and the outlet conduit. The flow switcher may change the downward flow from the inlet conduit to the annular region between the outlet conduit and the inlet conduit. The flow switcher may also change the upward flow from the inlet conduit to the annular region. The use of the flow switcher may allow the heater to operate at a higher temperature adjacent to the treatment area without increasing the initial temperature of the heat transfer fluid provided to the heaters.

For vertical, slanted, or L-shaped heaters where the flow of heat transfer fluid is directed down the inlet conduit and returns through the annular region between the inlet conduit and the outlet conduit, a temperature gradient may form in the heater with the hottest portion being located at a distal end of the heater. For L-shaped heaters, horizontal portions of a set of first heaters may be alternated with the horizontal portions of a second set of heaters. The hottest portions used to heat the formation of the first set of heaters may be adjacent to the coldest portions used to heat the formation of the second set of heaters, while the hottest portions used to heat the formation of the second set of heaters are adjacent to the coldest portions used to heat the formation of the first set of heaters. For vertical or slanted heaters, flow switchers in selected heaters may allow the heaters to be arranged with the hottest portions used to heat the formation of first heaters adjacent to coldest portions used to heat the formation of second heaters. Having hottest portions used to heat the formation of the first set of heaters adjacent to coldest portions used to heat the formation of the second set of heaters may allow for more uniform heating of the formation.

In some embodiments, solar salt (for example, a salt containing 60 wt % $NaNO_3$ and 40 wt % $KNO_3$) is used as the heat transfer fluid in the circulated fluid system. Solar salt may have a melting point of about 230° C. and an upper working temperature limit of about 565° C. In some embodiments, $LiNO_3$ (for example, between about 10% by weight and about 30% by weight $LiNO_3$) may be added to the solar salt to produce tertiary salt mixtures with wider operating temperature ranges and lower melting temperatures with only a slight decrease in the maximum working temperature as compared to solar salt. The lower melting temperature of the tertiary salt mixtures may decrease the preheating requirements and allow the use of pressurized water and/or pressurized brine as a heat transfer fluid for preheating the piping of the circulation system. The corrosion rates of the metal of the heaters due to the tertiary salt compositions at 550° C. is comparable to the corrosion rate of the metal of the heaters due to solar salt at 565° C. TABLE 1 shows melting points and upper limits for solar salt and tertiary salt mixtures. Aqueous solutions of tertiary salt mixtures may transition into a molten salt upon removal of water without solidification, thus allowing the molten salt to be provided and/or stored as aqueous solutions.

TABLE 1

| $NO_3$ Salt | Composition of $NO_3$ Salt (weight %) | Melting Point (° C.) of $NO_3$ salt | Upper working temperature limit (° C.) of $NO_3$ salt |
|---|---|---|---|
| Na:K | 60:40 | 230 | 600 |
| Li:Na:K | 12:18:70 | 200 | 550 |
| Li:Na:K | 20:28:52 | 150 | 550 |
| Li:Na:K | 27:33:40 | 160 | 550 |
| Li:Na:K | 30:18:52 | 120 | 550 |

Using molten salts as a heat transfer fluid for in situ heat treatment process has many advantages. Many molten salts will react with certain hydrocarbons, thus, if circulating molten salts are used to heat a portion of a treatment area, a leak in the system which allows molten salts to contact subsurface hydrocarbons may cause problems. Reaction of molten salts with hydrocarbons may disrupt heat transfer systems, decrease permeability in the treatment area, decrease hydrocarbon production, and/or impede the flow of hydrocarbons through at least a portion of the treatment area being heated by circulating molten salt heaters.

When a leak forms in one or more portions of a conduit of a circulating molten salt system, coke may form and/or infiltrate in the conduit adjacent to the leak. Coke deposits in one or more conduits in a heater may lead to several problems (for example, hot spots and/or heater failure). In some embodiments, an oxidizing fluid may be provided to one or more portions of the conduit. Oxidizing fluid may include, for example, air. Oxidizing fluid may oxidize any coke which has formed in the conduit.

In some embodiments, oxidizing fluid may be mixed with the molten salt before the molten salt is circulated through the heater in the formation. Mixing air with the molten salt may inhibit any significant coke formation in the conduits. As shown, heater 201 may be coupled to heat transfer fluid circulation system 202 and may include inlet conduit 214, and outlet conduit 216. Heat transfer fluid circulation system 202 may provide heat transfer fluid mixed with oxidizing fluid to inlet conduit 214 of L-shaped heater 201. In some embodiments, oxidizing fluid may be provided to one or more conduits of a heater intermittently and/or as needed.

In some embodiments, liner 240 (see FIG. 3) may be used in a wellbore and/or be coupled to a heater to inhibit fluids from mixing with circulating molten salts. In some embodiments, liner 240 may inhibit hydrocarbons from mixing with a heat transfer fluid (for example, one or more molten salts). Liner 240 may include one or more materials that are chemically resistant to corrosive materials (for example, metal or ceramic based materials).

As shown in FIG. 3, liner 240 is positioned in a wellbore. In some embodiments, liner 240 may be placed in the wellbore or the wellbore may be coated with chemically resistant material prior to positioning heater 201. In some embodiments, the liner may be coupled to the circulating molten salt heater. In some embodiments, the liner may include a coating on either the inner and/or outer surface of one or more of the conduits forming a circulating molten salt heater. In some embodiments, the liner may include a conduit substantially surrounding at least a portion of the conduit. In some embodiments, piping includes a liner that is resistant to corrosion by the fluid.

In some embodiments, electrical conductivity may be used to assess the inception, existence, and/or location of leaks in the heater using heat transfer fluids such as molten salts. A resistance across one or more conduits of, for example, a conduit-in-conduit heater may be monitored for any changes. Changes in the monitored resistance may indicate the inception and/or worsening of a leak in the conduit. The conduits forming the conduit-in-conduit heater may include a void in the walls forming the conduits. The void in the walls forming the conduit may include a thermal insulation material positioned in the void. If a breach forms in the conduit walls, heat transfer fluid may enter through the breach leaking through to the other side. Some heat transfer fluids, for example molten salts, leaking through the breach in the conduit may conduct electricity creating a short across the conduit wall. The electrical short created by the leaking molten salt may then modify the measured resistance across the conduit wall in which the breach has occurred.

Figure 6:
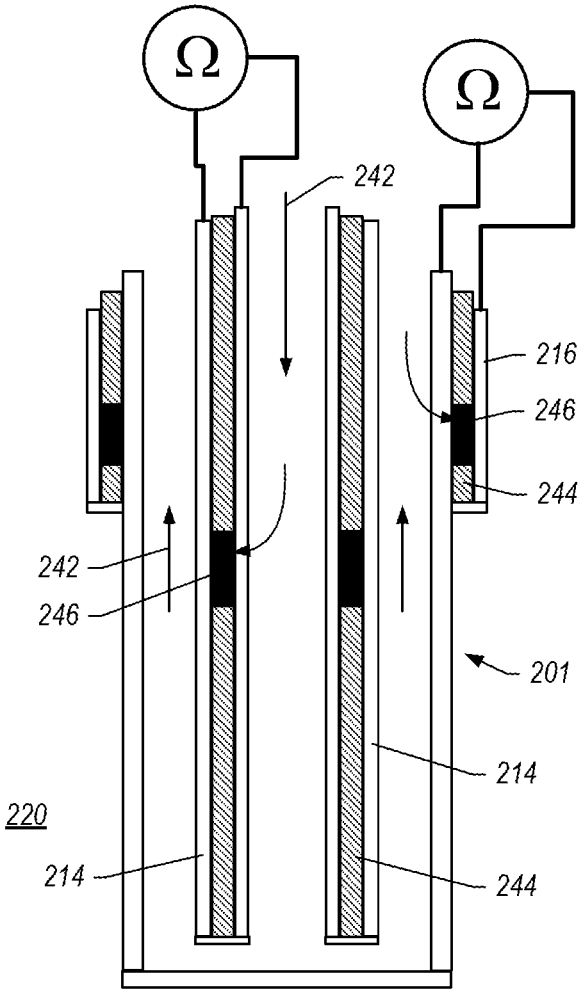
FIG. 6 depicts a schematic representation of an embodiment of a vertical heater for use with a heat transfer fluid circulation system for heating a portion of a formation including an electrical resistance leak detection system.

In some embodiments, the electrical resistance of at least one of the conduits of the conduit-in-conduit heaters may be assessed. A presence of a leak in at least one of the conduits may be assessed based on the assessed resistance. The electrical resistance may be assessed intermittently or on a continuous basis. The electrical resistance may be assessed for either one or both conduits of the conduit-in-conduit heater. FIG. 6 depicts a schematic representation of an embodiment of vertical conduit-in-conduit heater 201 for use with a heat transfer fluid circulation system for heating a portion of a formation (for example, hydrocarbon layer 220). The heat transfer fluid circulation system may provide heat transfer fluid 242 to inlet conduit 214 of heater 201. The heat transfer fluid circulation system may receive heat transfer fluid 242 from outlet conduit heat 216. One or more portions of conduits 214 and 216 may include insulation 244 positioned between the inner and outer walls of the conduits. Multiple breaches 246 may occur in conduits 214 and 216 through which heat transfer fluid 242 leaks.

Figure 7:
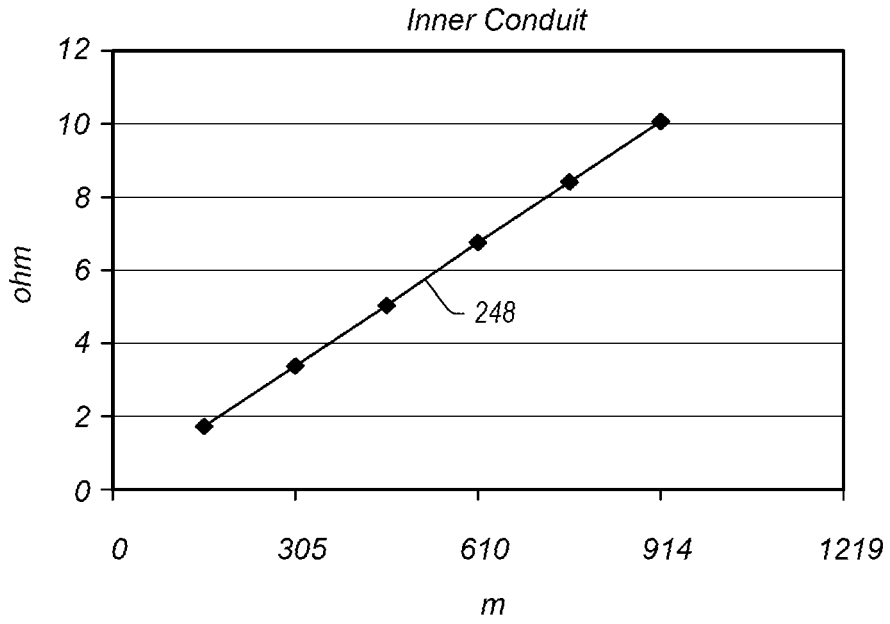
FIG. 7 depicts a graphical representation of the relationship of the electrical resistance of an inner conduit of a conduit-in-conduit heater over a depth at which a breach has occurred in the inner conduit of the conduit-in-conduit heater.
Figure 8:
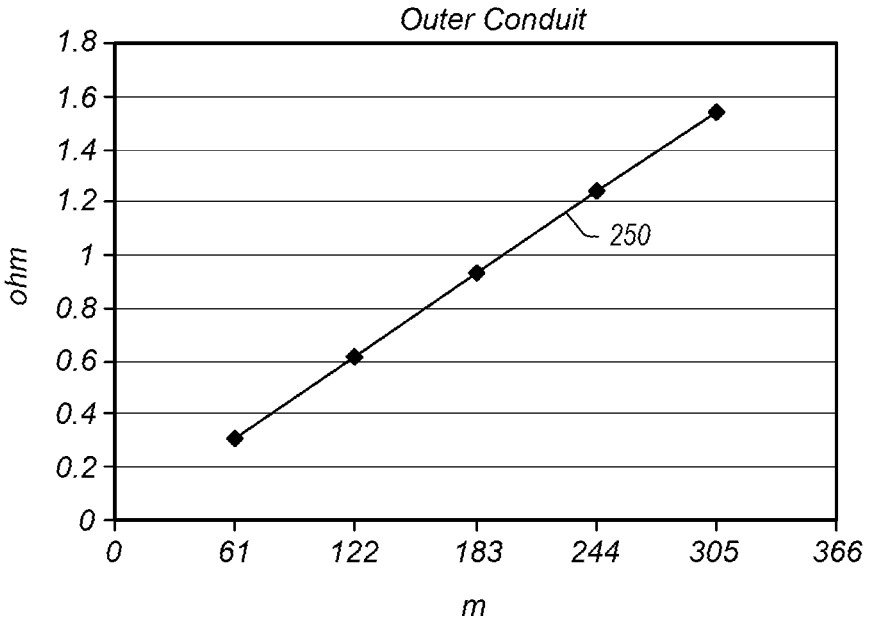
FIG. 8 depicts a graphical representation of the relationship of the electrical resistance of an outer conduit of a conduit-in-conduit heater over a depth at which a breach has occurred in the outer conduit of the conduit-in-conduit heater.

In some embodiments, a location of a breach in the conduit may be assessed. The location may be assessed due to the fact that the relationship between the electrical resistance and the depth at which the breach has occurred is very linear as is demonstrated in FIGS. 7 and 8. FIG. 7 depicts a graphical representation of the relationship (line 248) of the electrical resistance of an inner conduit of a conduit-in-conduit heater over a depth at which a breach has occurred in the inner conduit of the conduit-in-conduit heater. FIG. 8 depicts a graphical representation of the relationship (line 250) of the electrical resistance of an outer conduit of a conduit-in-conduit heater over a depth at which a breach has occurred in the outer conduit of the conduit-in-conduit heater. This linear relationship may allow the approximate depth of a breach in a conduit to be assessed and therefore the approximate location of the breach in the conduit. Once the location of a breach is assessed, options for dealing with the breach may be determined.

Figure 9:
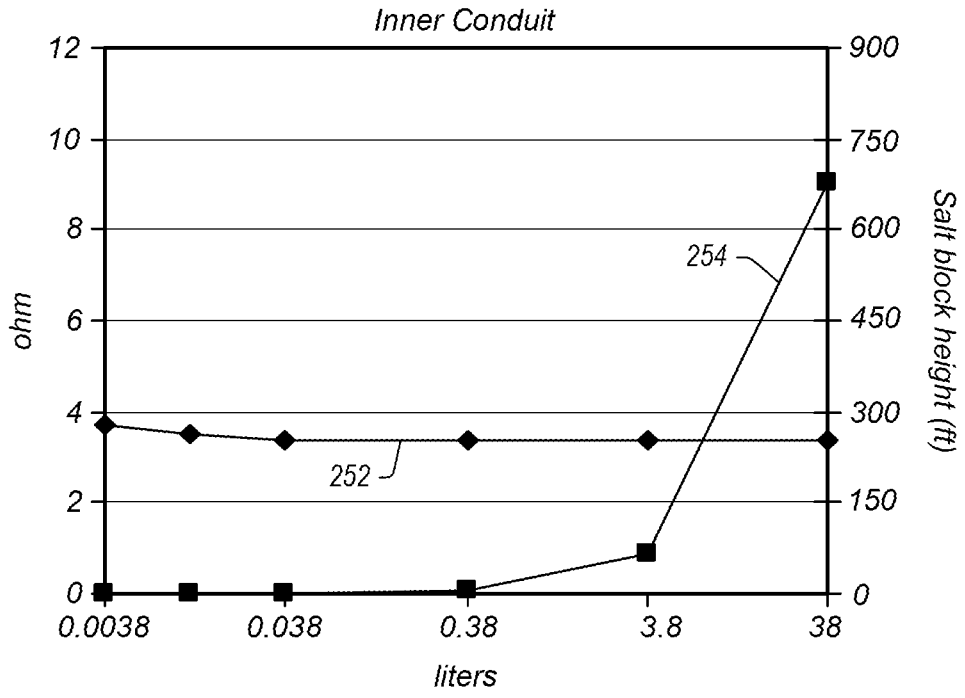
FIG. 9 depicts a graphical representation of the relationship of the electrical resistance of an inner conduit of a conduit-in-conduit heater and the salt block height over an amount of leaked molten salt.
Figure 10:
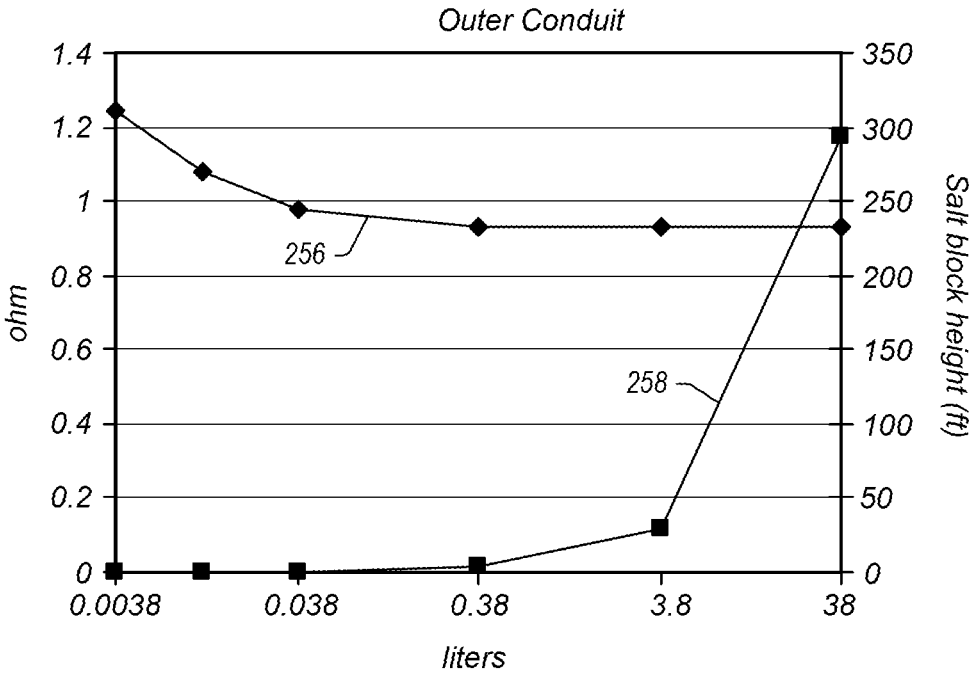
FIG. 10 depicts a graphical representation of the relationship of the electrical resistance of an outer conduit of a conduit-in-conduit heater and the salt block height over an amount of leaked molten salt.

FIG. 9 depicts a graphical representation of the relationship of the electrical resistance of an inner conduit of a conduit-in-conduit heater (line 252) and the salt block height (line 254) over an amount of leaked molten salt. FIG. 10 depicts a graphical representation of the relationship of the electrical resistance of an outer conduit of a conduit-in-conduit heater (line 256) and the salt block height (line 258) over an amount of leaked molten salt. As demonstrated in FIGS. 9 and 10 a small leak in one or more of the conduits in the conduit-in-conduit heater may be detected. For example, a molten salt leak of as little as 0.038 liters may be detected by monitoring the electrical resistance across a wall of the conduit. FIGS. 9 and 10 also demonstrate (lines 254 and 258) that even a relatively small leak will fill a relatively large portion of the annulus space of the conduit-in-conduit heater. For example, 0.038 liters of leaked molten salt may fill approximately 2.04 m of the inner conduit or approximately 0.76 m of the outer conduit.

Figure 11:
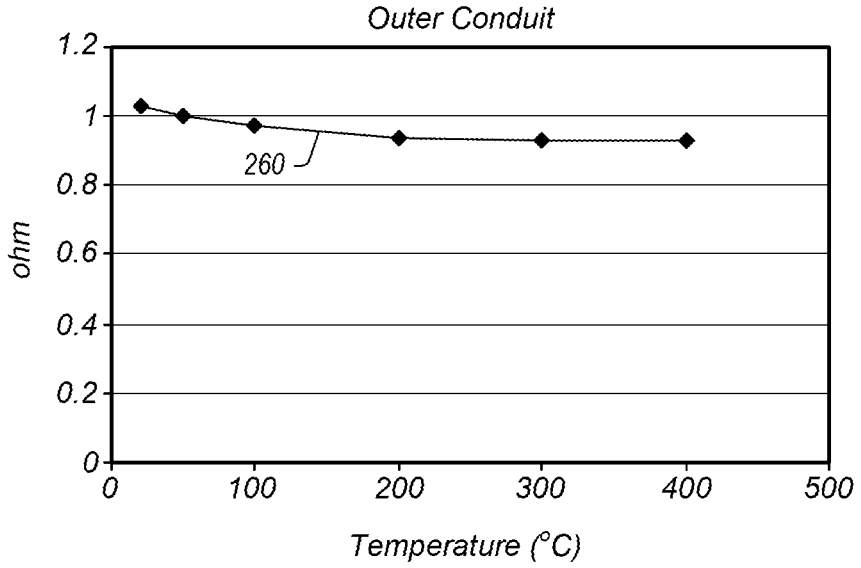
FIG. 11 depicts a graphical representation of the relationship of the electrical resistance of a conduit of a conduit-in-conduit heater once a breach forms over an average temperature of the molten salt.

FIG. 11 depicts a graphical representation of the relationship (line 260) of the electrical resistance of a conduit of a conduit-in-conduit heater once a breach forms over an average temperature of the molten salt. As FIG. 11 demonstrates, if a breach in one of the conduits of the conduit-in-conduit heater does occur the impact on the temperature is relatively small.

In some embodiments, a gas in combination with, for example, a gas detection system may be used to detect a breach, and subsequent leaks, in one or more conduits of a conduit-in-conduit heater. One or more gases may be dissolved in the heat transfer fluid, for example a molten salt. The gas may be dissolved in the molten salt before the molten salt is transferred to the conduit-in-conduit heater (for example, in a storage tank used to store the molten salt). The gas may be dissolved in the molten salt as the molten salt is injected in the heater. The dissolved gas may circulate through the heater along with the molten salt.

In some embodiments, one or more of the gases may include an inert gas (for example, nitrogen, argon, helium, or mixtures thereof). In some embodiments, the gas detection system may include a pressure transducer or a gas analyzer. A breach in a conduit of the heater may result in a leak of at least some of the circulating molten salts in the annulus space of the conduit. Once the molten salt leaks in the annular space of the conduit, at least some of the gas dissolved in the molten salt may be released from the molten salt in the annular space of the conduit. The annular space may be under reduced pressure (for example, in order to provide more insulation value) and reduced temperature. The reduced pressure of the annular space may further facilitate the release of the dissolved gas from any molten salts which have leaked in the annular space. Table 2 shows the solubility of several inert gases including helium, argon, and nitrogen in molten nitrates. Solubility of the gas in the salt may generally scale substantially linearly with partial pressure according to Henry's Law.

TABLE 2

| | T [° C.] | kH [mol/ml bar] | DH [kJ/mol] |
|---|---|---|---|
| He + $NaNO_3$ | 332 | 1.86 | 13.4 |
| | 391 | 2.32 | |
| | 441 | 2.80 | |
| Ar + $NaNO_3$ | 331 | 0.64 | 15.8 |
| | 410 | 0.90 | |
| | 440 | 1.04 | |
| $N_2$ + $NaNO_3$ | 331 | 0.50 | 16.0 |
| | 390 | 0.64 | |
| | 449 | 0.84 | |
| He + $LiNO_3$ | 270 | 1.51 | |
| Ar + $LiNO_3$ | 273 | 0.91 | 14.0 |
| $N_2$ + $LiNO_3$ | 277 | 0.73 | |

Figure 12:
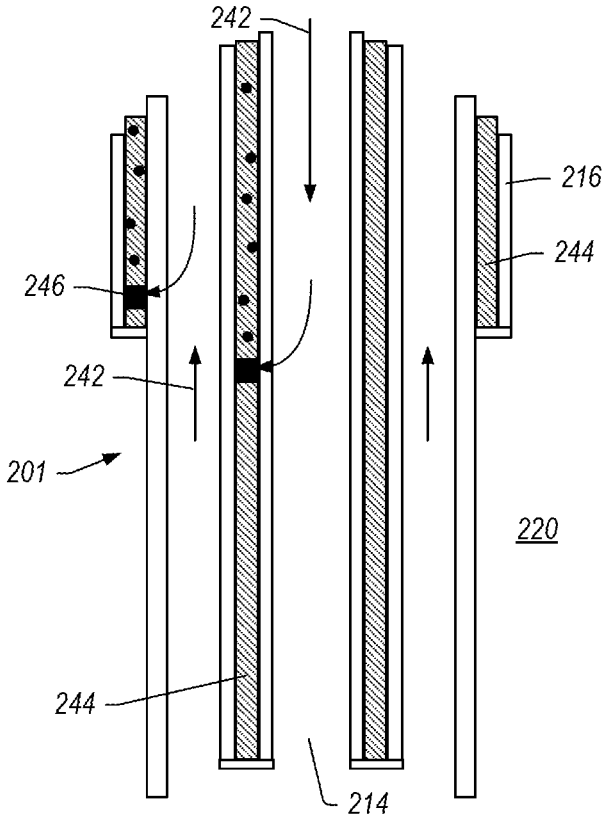
FIG. 12 depicts a schematic representation of an embodiment of a vertical heater for use with a heat transfer fluid circulation system for heating a portion of a formation including an inert gas based leak detection system.

The gas released from the heater may be detected by the gas detection system. The gas detection system may be coupled to one or more openings in fluid communication with the annular space of the conduit. Heaters currently in use may have preexisting openings which may be adapted to accommodate the gas detection system. Heaters currently in use may be retrofitted for the currently described leak detection system. FIG. 12 depicts a schematic representation of an embodiment of vertical heater 201 for use with a heat transfer fluid circulation system for heating a portion of a formation (for example, hydrocarbon layer 220) which is coupled to an inert gas based leak detection system (not depicted).

In some embodiments, the gas detection system may be coupled to a plurality of heaters. Once a heater has formed a breach in one of the conduits, the heater in question may be identified by sequentially isolating each heater coupled to the gas detection system. In some embodiments, a leak detection system based upon detection of gases in annular spaces may not be able to assist in assessing the location of the breach (as the electrical resistance leak detection system may allow). In some embodiments, a leak detection system based upon detection of gases in annular spaces may not be able to assist in assessing the formation of breaches in one or more conduits along any horizontal portions.

The use of circulating molten salts to heat underground hydrocarbon containing formations has many advantages relative to other known methods of heating a formation. It would be advantageous to be able to shut down a heating system using circulating molten salts in a more controlled manner. As opposed to other types of heating systems one cannot simply turn off a heat transfer fluid based heating system. Heat transfer fluid must be removed from the conduits of the conduit-in-conduit heaters during a shut-down procedure. When the heat transfer fluid is molten salt, removal of the salts presents different challenges. If the circulating pumps are turned off the molten salt will begin to cool and solidify clogging the conduits. Due to the fact that salts are typically soluble in one or more solvents, one strategy for removing the salt from the heater conduits is to flush the conduits with an aqueous solution. However, flushing the conduits with an aqueous solution may take anywhere from days to months depending on the temperature of the formation. In some embodiments, secondary fluids (for example, fluids produced during in situ heat treatment and/or conversion processes) may be used to flush out salts from the conduits. Due to the typically higher boiling point of secondary fluids, removing remaining salts from the conduits may be accomplished faster than using an aqueous solution (for example, from hours to days instead of days to months). In some embodiments, a "pig" may be used to push the salts out of the conduits. A pig may include any material or device which will fit within the confines of the conduit in conduit heaters such that the pig will move through the conduit while allowing a minimal amount of salt to pass around the pig as it is conveyed through the conduit. Typically a pig is conveyed through a conduit using hydraulic pressure. Using a pig to remove heat transfer fluids may reduce the shut-down time for the circulating molten salt heater to a time period measured in hours. Using a pig to shut-down the heater may include the use of additional specialized surface equipment (for example, modified wellheads, specially designed pigging system for high temperature applications). In certain embodiments, only U-shaped heaters may use a pig during a shut-down procedure. All three shut-down methods have different advantages.

Fluids may be used to shut-down circulating molten salt heaters. In some embodiments, compressed gases may be used to shut-down circulating molten salt heaters. Compressed gases may combine many of the different advantages of the other three shut-down methods.

Using compressed gases to shut-down circulating molten salt heaters may have several advantages over using aqueous solutions or secondary fluids. Using compressed gases may be faster, require fewer surfaces resources, more mobile, and allow for emergency shutdown relative to using aqueous solutions or secondary fluids. Using compressed gases to shut-down circulating molten salt heaters has several advantages over using a pig and compressed gases to convey the pig. Using compressed gases may require fewer surfaces resources and have fewer limitations on what types of heaters may be shut down relative to using a pig and compressed gases to convey the pig.

Some of the disadvantages of using compressed gases include reduced efficiency of salt displacement relative to using aqueous solutions or secondary fluids. In some embodiments, a displacement efficiency of the conveyance of molten salts moving through a conduit heater may be changed by varying the transient pressure profile. Using compressed gases to convey molten salts may result in different types of flow profiles. Varying transient pressure profiles may result in various pressure profiles including, for example, Taylor flow, dispersed bubble flow, churn flow, or annular flow. Taylor flow may be generally described as a two phase flow pattern such that the gas and molten salt move through the conduit as separate portions (except for a thin film of molten salts along the walls of the conduit between the walls and the portions of gases). Dispersed bubble flow may be generally described as a multiphase flow profile in which the compressed gas moves as small dispersed bubbles through the molten salt. Churn flow may be generally described as a multiphase flow profile (typically observed in near-vertical pipes) in which large, irregular slugs of gas move up the approximate center of the conduit, usually carrying droplets of molten salt with them. Most of the remaining molten salt flows up along the conduit walls. As opposed to Taylor flow, neither phase is continuous and the gas portions are relatively unstable, and take on large, elongated shapes. Churn flow may occur at relatively high gas velocity and as the gas velocity increases, it changes into annular flow. Annular flow may be generally described as a multiphase flow profile in which the compressed gas flows in the approximate center of the conduit, and the molten salt is substantially contained in a thin film on the conduit wall. Annular flow typically occurs at high velocities of the compressed gas, and may be observed in both vertical and horizontal wells.

Figure 13:
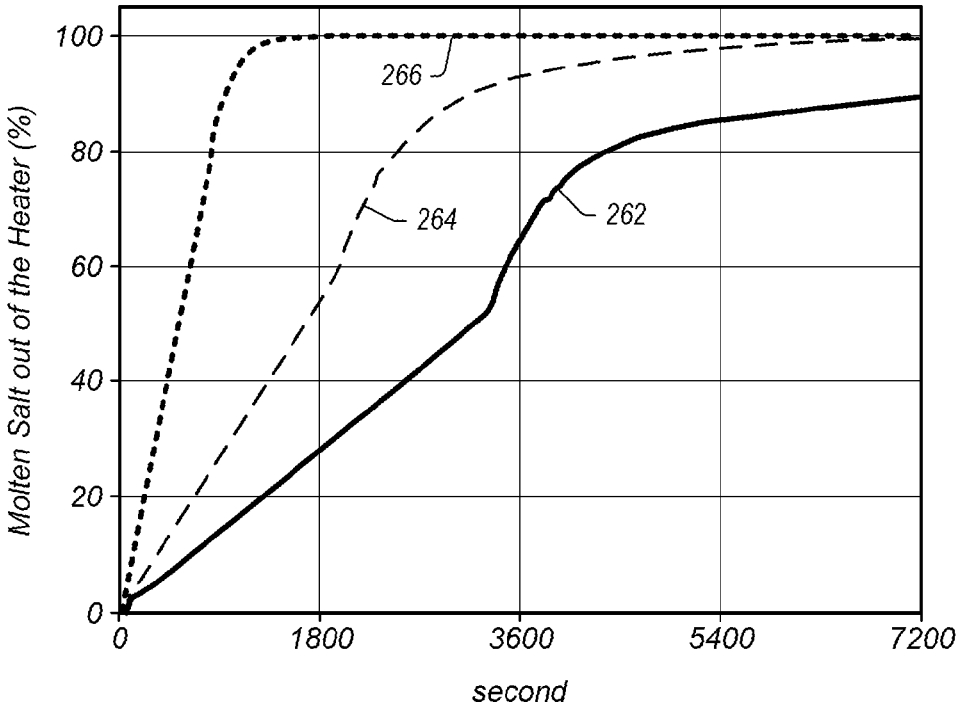
FIG. 13 depicts a graphical representation of the relationship of the salt displacement efficiency over time for three different compressed air mass flow rates.
Figure 14:
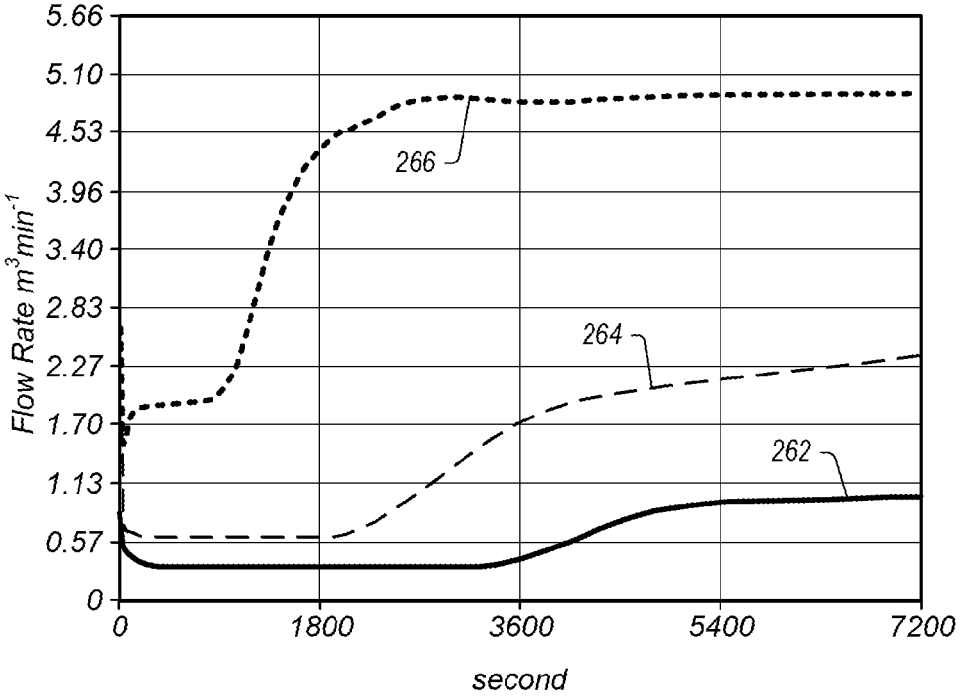
FIG. 14 depicts a graphical representation of the relationship of the air volume flow rate at inlet of a conduit over time for three different compressed air mass flow rates.
Figure 15:
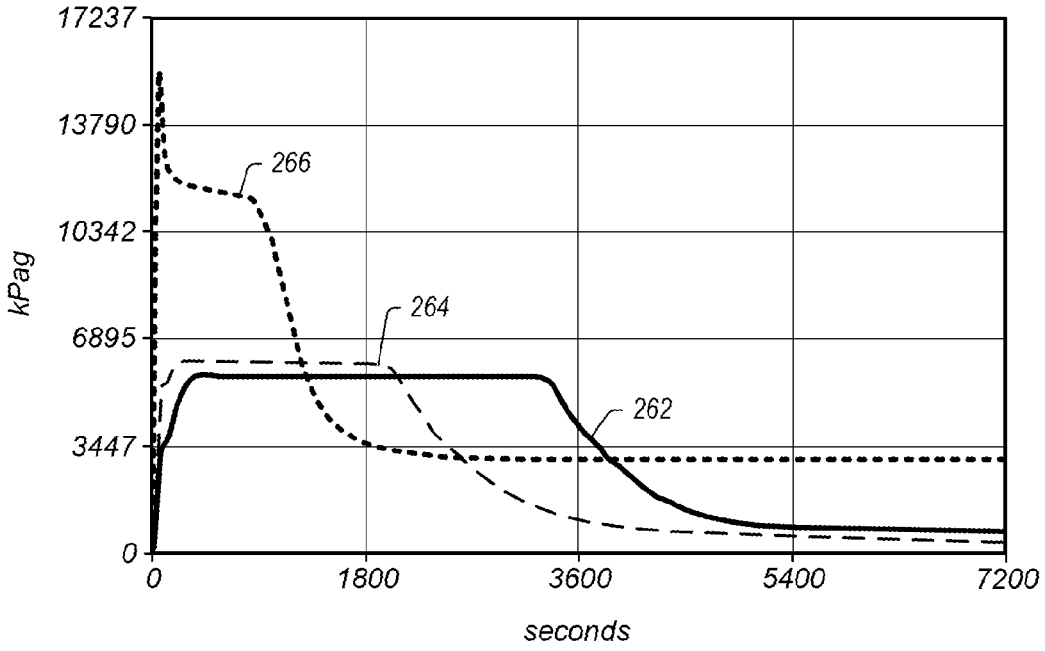
FIG. 15 depicts a graphical representation of the relationship of the compressor discharge pressure over time for three different compressed air mass flow rates.
Figure 16:
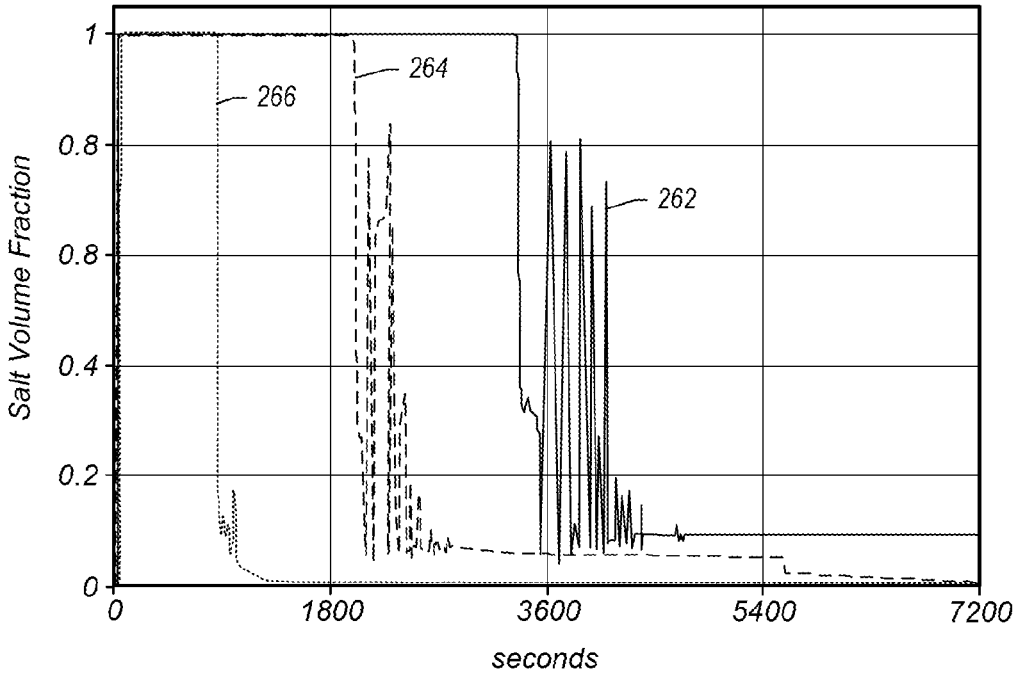
FIG. 16 depicts a graphical representation of the relationship of the salt volume fraction at outlet of a conduit over time for three different compressed air mass flow rates.
Figure 17:
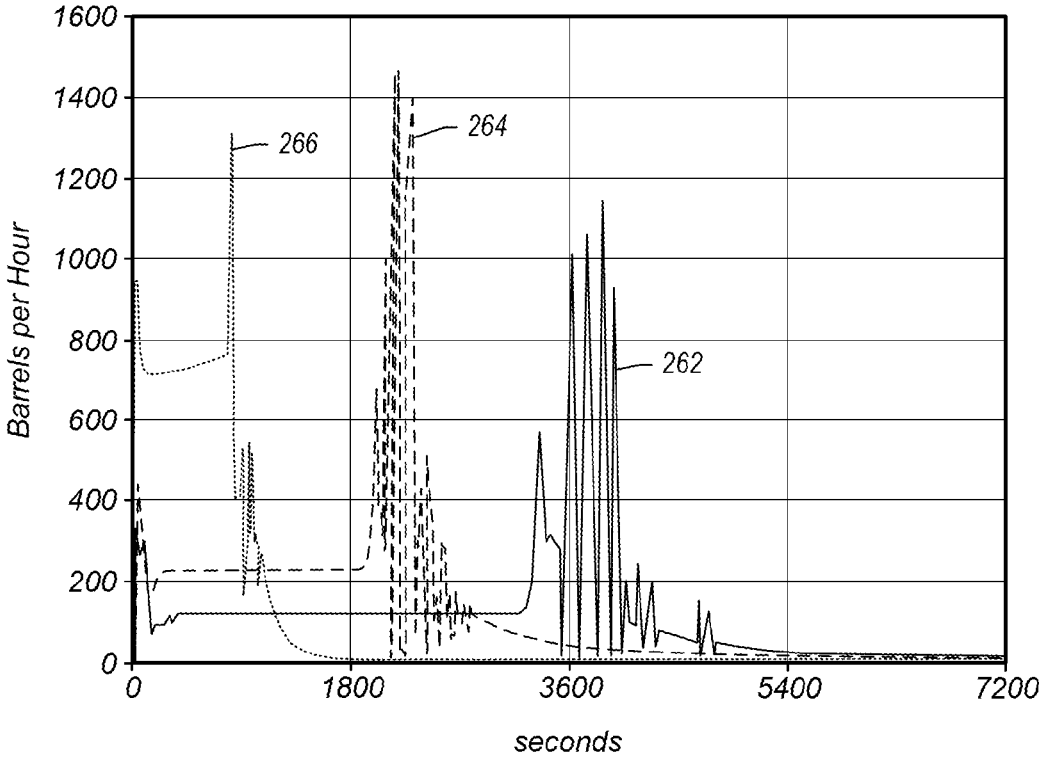
FIG. 17 depicts a graphical representation of the relationship of the salt volume flow rate at outlet of a conduit over time for three different compressed air mass flow rates.

Taylor flow may result in maximum displacement efficiency. In some embodiments, modifying the transient pressure profile of compressed gases may allow a maximum displacement efficiency (for example, a Taylor flow profile) to be achieved during shut-down of circulating molten salt heaters. FIGS. 13-17 depict graphical representations on the effect of varying the compressed air mass flow rate (from 1 lb/s (lines 262) to 2 lb/s (lines 264) to 10 lb/s (lines 266)) when using compressed gas to shut-down circulating molten salt heaters. FIG. 13 depicts a graphical representation of the relationship of the salt displacement efficiency over time for three different compressed air mass flow rates. FIG. 14 depicts a graphical representation of the relationship of the air volume flow rate at inlet of a conduit over time for the three different compressed air mass flow rates. FIG. 15 depicts a graphical representation of the relationship of the compressor discharge pressure over time for the three different compressed air mass flow rates. FIG. 16 depicts a graphical representation of the relationship of the salt volume fraction at outlet of a conduit over time for the three different compressed air mass flow rates. FIG. 17 depicts a graphical representation of the relationship of the salt volume flow rate at outlet of a conduit over time for the three different compressed air mass flow rates. FIGS. 13-17 show that higher compressed air mass flow rates are desirable as regards quickly and efficiently shutting down circulating molten salt heaters.

Figure 18:
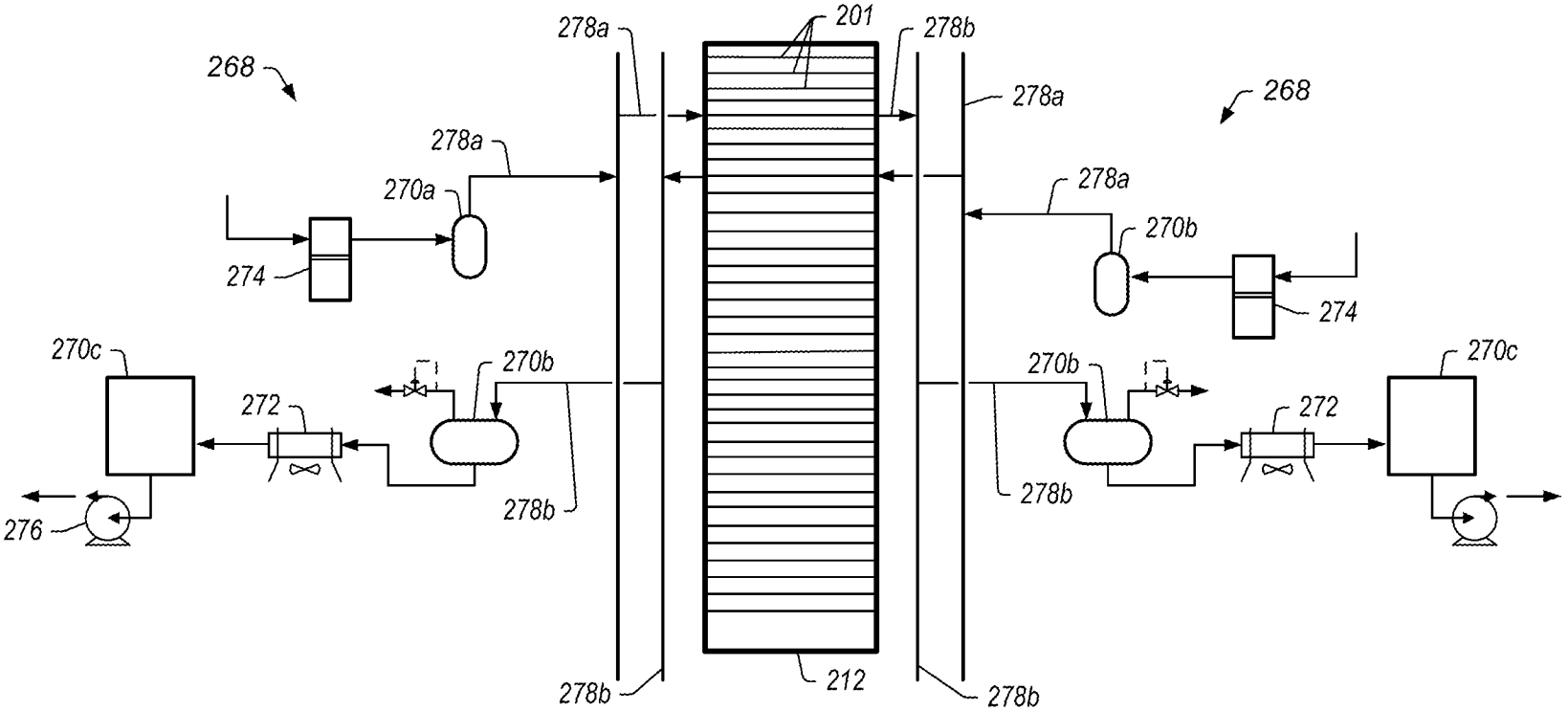
FIG. 18 depicts a schematic representation of an embodiment of a compressed air shut-down system.

FIG. 18 depicts a schematic representation of an embodiment of compressed gas shut-down system 268. In some embodiments, compressed gas shut-down system 268 may include storage tanks 270A-C, heat exchangers 272, compressors 274, pumps 276, and piping 278A-B. Compressor 274 may compress gas to be used in shut-down system 268. Gases may include air, inert gases, byproducts of subsurface treatment processes, or mixtures thereof. Compressed gases are transferred from compressor 274 to storage tank 270A. Compressed air may be transferred from storage tank 270A using piping 278A to a first end of U-shaped circulating molten salt heaters 201 positioned in formation 212. The compressed air pushes molten salt out of a second end of U-shaped circulating molten salt heaters 201 through piping 278B to storage tank 270B. In some embodiments, storage tank 270B may include a surge vessel which functions to absorb process disturbance and/or momentary unexpected flow changes. The surge vessel may allow compressed air to escape while inhibiting removed salts from escaping. Molten salts may be conveyed from storage tank 270B through heat exchanger 272 to storage tank 270C. Salts in storage tanks 270C may be conveyed using pumps 276 to a second set of U-shaped circulating molten salt heaters to heat another formation and/or a second portion of the formation. Compressed gas shut-down system 268 depicted in FIG. 18 includes two independent systems. The two shut-down systems may be operated independently of each other.

In some embodiments, the molten salt includes a carbonate salt or a mixture of carbonate salts. Examples of different carbonate salts may include lithium, sodium, and/or potassium carbonate salts. The molten salt may include about 40% to about 60% by weight lithium carbonate, from about 20% to about 40% by weight sodium carbonate salt and about 20% to about 30% by weight potassium carbonate. In some embodiments, the molten salt is a eutectic mixture of carbonate salts. The eutectic carbonate salt mixture may be a mixture of carbonate salts having a melting point above 390° C., or from about 390° C. to about 700° C., or about 600° C. The composition of the carbonate molten salt may be varied to produce a carbonate molten salt having a desired melting point using for example, known phase diagrams for eutectic carbonate salts. For example, a carbonate molten salt containing 44% by weight lithium carbonate, 31% by weight sodium carbonate, and 25% by weight potassium carbonate has a melting point of about 395° C. Due to higher melting points, heat transfer from hot carbonate molten salts to the formation may be enhanced. Higher temperature may reduce the time necessary to heat the formation to a desired temperature.

In some in situ heat treatment process embodiments, a circulation system containing carbonate molten salts is used to heat the formation. Using the carbonate molten salt circulation system for in situ heat treatment of a hydrocarbon containing formation may reduce energy costs for treating the formation, reduce the need for leakage surveillance, and/or facilitate heating system installation.

In some embodiments, a carbonate molten salt is used to heat the formation. In some embodiments, a carbonate molten salt is provided to piping in a formation after the formation has been heated using a heat transfer fluid described herein. The use of a carbonate molten salt may allow the formation to be heated if piping in the formation develops leakage. In some embodiments, disposable piping may be used in the formation. In some embodiments, carbonate molten salts are used in circulation systems that have been abandoned. For example, a carbonate molten salt may be circulated in piping in a formation that has developed leaks.

Figure 19:
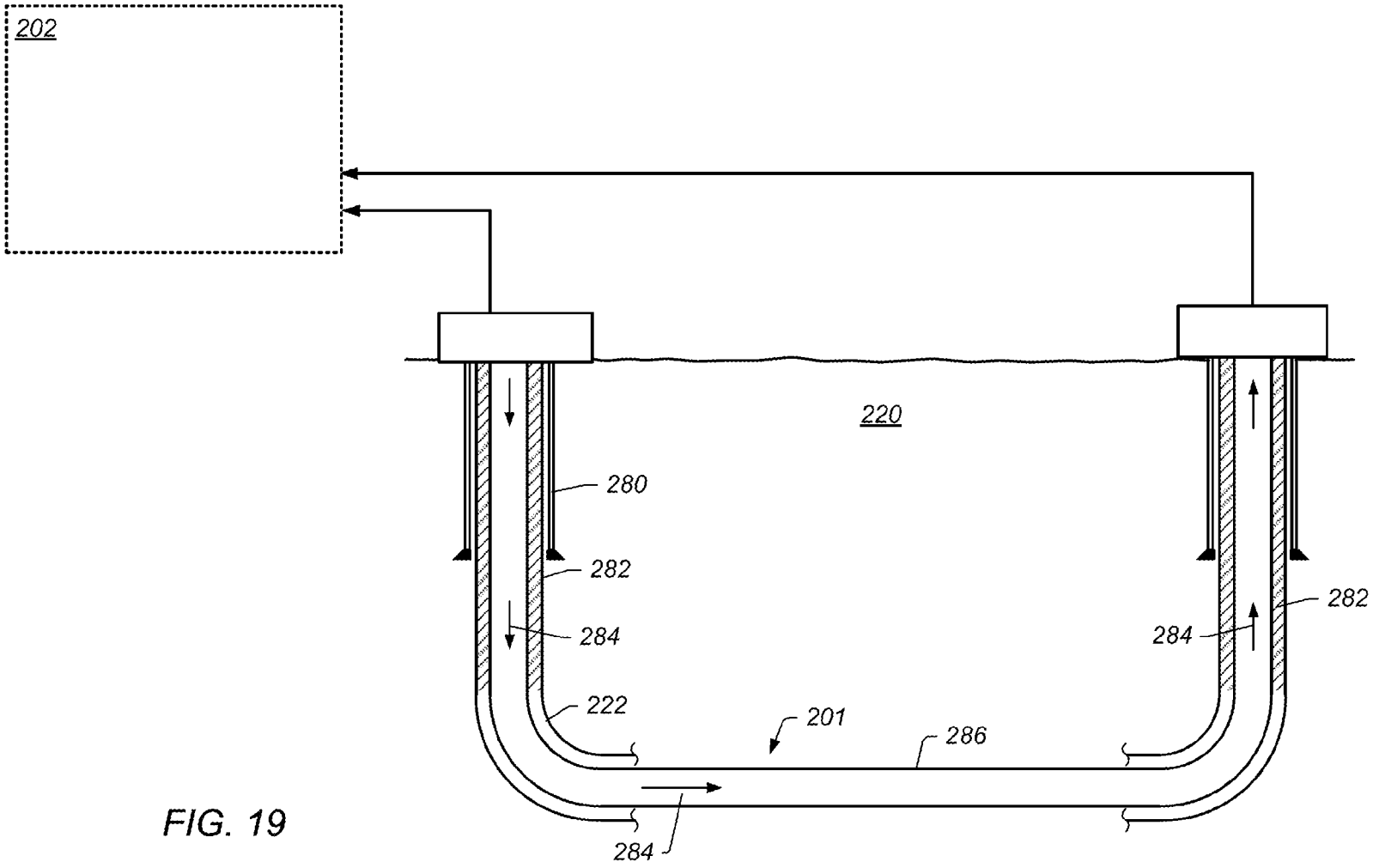
FIG. 19 depicts a schematic representation of a system for heating a formation using carbonate molten salt.
Figures 20, 21:
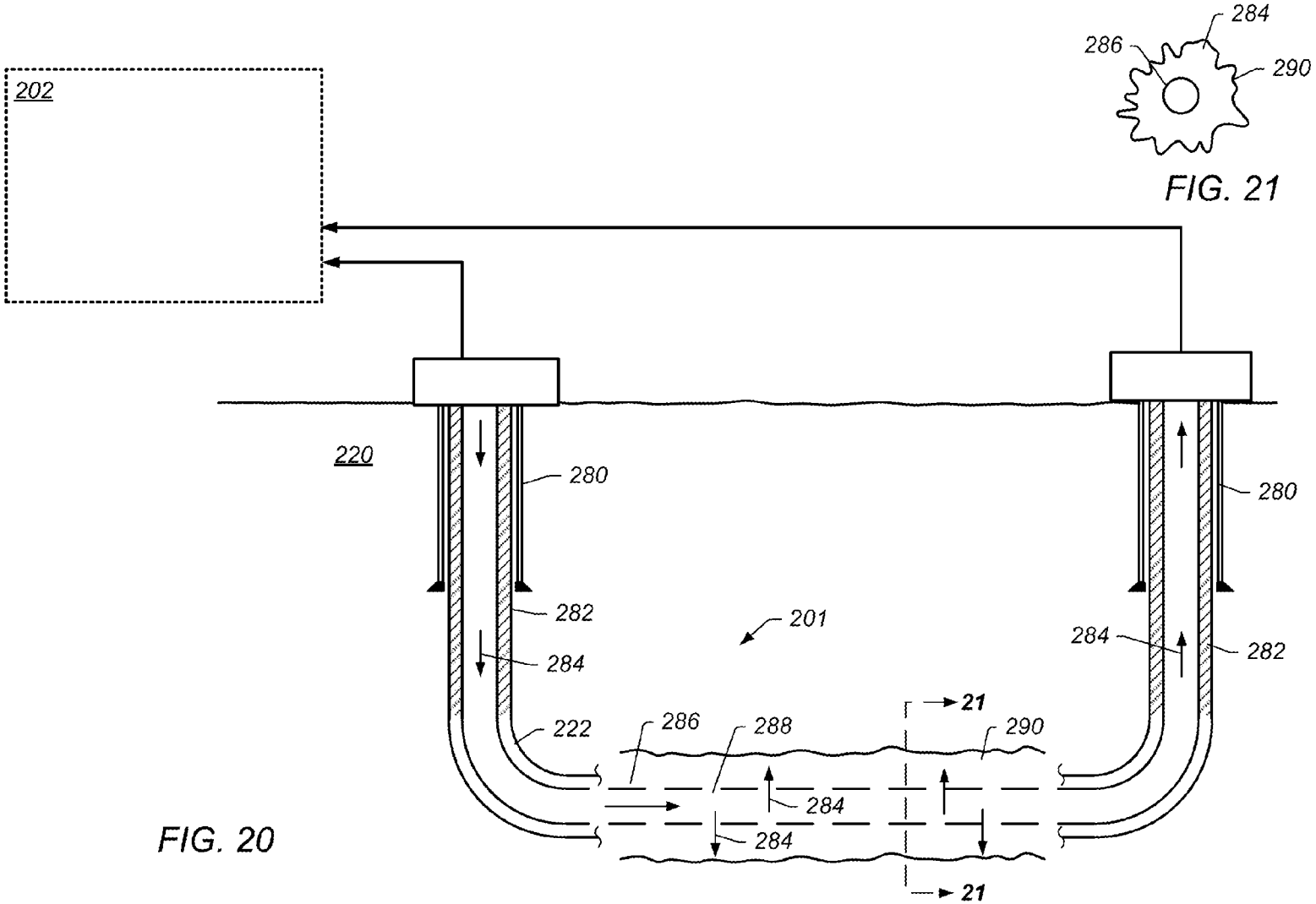
FIG. 20 depicts a schematic representation of a system after heating a formation using carbonate molten salt.
FIG. 21 depicts a cross-sectional representation of an embodiment of a section of the formation after heating the formation with a carbonate molten salt.

FIG. 19 depicts a schematic representation of a system for heating a formation using carbonate molten salt. FIG. 20 depicts a schematic representation of an embodiment of a section of the formation after heating the formation with a carbonate molten salt over a period of time. FIG. 21 depicts a cross-sectional representation of an embodiment of a section of the formation after heating the formation with a carbonate molten salt. Piping may be positioned in the u-shaped wellbore to form u-shaped heater 201. Heater 201 is positioned in wellbores 222 and connected to heat transfer fluid circulation system 202 by piping. Wellbore 222 may be an open wellbore. In some embodiments, the vertical or overburden portions 280 of wellbore 222 are cemented with non-conductive cement or foam cement. Portions 282 of heater 201 in the overburden may be made of material chemically resistant to hot carbonate salts (for example, stainless steel tubing). Portion 286 of heater 201 may be manufactured from materials that degrade over time. For example, carbon steel, or alloys having a low chromium content. Carbonate molten salt 284 may enter one end of heater 201 and exit another end of the heater. Flow of hot carbonate molten salt 284 provides heat to at least a portion of hydrocarbon layer 220.

Over time contact of carbonate molten salt 284 may degrade or decompose parts of portion 286 of heater 201 to form openings in the portion (as shown in FIG. 20). In some embodiments, portion 286 may include perforations that may be opened or have coverings made of material that degrades over time that allows carbonate molten salt 284 to flow into hydrocarbon layer 220. As hot carbonate molten salt contacts cooler portions of hydrocarbon layer 220, the hot carbonate molten salt may cool and solidify. Formation of openings in portion 286 may allow carbonate molten salt 284 to flow into a second portion of hydrocarbon layer 220. As carbonate molten salt 284 enters a cooler section of the formation, the carbonate molten salt may become solid or partially solidify. The solidified carbonate molten salt may liquefy or melt when contacted with new hot molten carbonate salt flowing through heater 201. Melting of the solid molten carbonate salt may move more carbonate molten salt into hydrocarbon layer 220. The cycle of solidification and melting of the carbonate molten salt may create permeable heater 290 that surrounds portion 286 of heater 201, (as shown in FIG. 21). Permeable heater 290 may have a diameter at least about 1 diameter or about 2 diameters greater than portion 286 of heater 201. Formation of permeable heater 290 in situ may allow the carbonate molten salt flow through the permeable heater and heat additional portions of hydrocarbon layer 220. The ability to heat additional portion of hydrocarbon layer 220 with a permeable heater may reduce the amount of heaters required and/or time necessary to heat the formation.

In some embodiments, permeability or injectivity in a hydrocarbon containing formation is created by selectively fracturing portions of the formation. A solid salt composition may be injected into a section of the formation (for example, a lithium/sodium/potassium nitrate salts and/or lithium/sodium/potassium carbonate salts). In some embodiments, the solid salt composition is moved through the formation using a gas, for example, carbon dioxide, or hydrocarbon gas. In some embodiments, the solid salt composition may be provided to the formation as an aqueous slurry. Heat may be provided from one or more heaters to heat the portion to about a melting point of the salt. The heaters may be temperature limited heaters. As the solid salt composition becomes molten or liquid, the pressure in the formation may increase from expansion of the melting solid salt composition. The expansion pressure may be at a pressure effective to fracture the formation, but below the fracture pressure of the overburden. Fracturing of the section may increase permeability of the formation. In some embodiments, at least a portion of the heated solid salt compositions contacts at least some hydrocarbons causes an increase in pressure in the section and create fractures in the formation.

The molten salt may move through the formation towards cooler portions of the formation and solidify. In some embodiments, heaters may be positioned in some of the fractures in the section and heat is provided to a second section of the formation. In some embodiments, heat from the heaters in the fractures may melt or liquefy the solid salt composition and more fractures may be formed in the formation. In some embodiments, the heaters melt the molten salt and heat from the molten salt is transferred to the formation. In some embodiments, fluid is injected into at least some of fractures formed in the section. Use of molten salts to increase permeability in formations may allow heating of relatively shallow formations with low overburden fracture pressures.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a core" includes a combination of two or more cores and reference to "a material" includes mixtures of materials.

In this patent, certain U.S. patents and U.S. patent applications have been incorporated by reference. The text of such U.S. patents and U.S. patent applications is, however, only incorporated by reference to the extent that no conflict exists between such text and the other statements and drawings set forth herein. In the event of such conflict, then any such conflicting text in such incorporated by reference U.S. patents and U.S. patent applications is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method of treating a subsurface formation, comprising:

circulating a heated carbonate molten salt through at least one conduit of a conduit-in-conduit heater positioned in a wellbore located in the formation;

heating hydrocarbons in at least a portion of the formation with heat from the circulating heated carbonate molten salt, wherein the hydrocarbons are heated to a mobilization temperature of the hydrocarbons; and producing at least some of the heated hydrocarbons from the formation.

2. The method of claim 1, wherein the heated carbonate molten salt comprises sodium, potassium, and lithium carbonate salts.

3. The method of claim 1, wherein the heated carbonate molten salt has a melting point of at least 390° C.

4. The method of claim 1, wherein the heated carbonate molten salt has a melting point of about 600° C.

5. The method of claim 1, wherein the heated carbonate molten salt comprises a eutectic mixture of sodium, potassium and lithium carbonate salts.

6. The method of claim 1, further comprising allowing at least a portion of the heated carbonate molten salt to flow through openings in the conduit-in-conduit heater and into the formation.

7. The method of claim 6, wherein the openings in the conduit-in-conduit heater are formed by degradation over time of portions of the conduit-in-conduit heater by the heated carbonate molten salt.

8. The method of claim 6, wherein the openings in the conduit-in-conduit heater comprise coverings that degrade over time in the presence of the heated carbonate molten salt.

9. The method of claim 1, wherein the wellbore comprises an open wellbore.

10. A method of treating a subsurface formation, comprising:

circulating a heated carbonate molten salt through at least one conduit of a conduit-in-conduit heater positioned in a wellbore located in the formation;

heating hydrocarbons in at least a first portion of the formation with heat from the circulating heated carbonate molten salt, wherein the hydrocarbons are heated to a mobilization temperature of the hydrocarbons;

allowing at least a portion of the carbonate molten salt to flow through openings in the conduit-in-conduit heater and into a second portion of the formation;

allowing at least some carbonate molten salt in the second portion to cool and at least partially solidify in the second portion, wherein the solidified carbonate molten salt forms a permeable heater in the second portion that surrounds a portion of the conduit-in-conduit heater;

providing at least some additional heated molten carbonate salt through the permeable heater to heat at least one additional portion of the formation, wherein the at least one additional portion is adjacent the permeable heater; and producing at least some of the heated hydrocarbons from the formation.

11. The method of claim 10, wherein the heated carbonate molten salt has a melting point of at least 390° C.

12. The method of claim 10, further comprising forming the openings in the conduit-in-conduit heater by degrading portions of the conduit-in-conduit heater with the heated carbonate molten salt over time.

13. The method of claim 10, wherein the openings in the conduit-in-conduit heater comprise openings with coverings that degrade over time in the presence of the heated carbonate molten salt.

14. The method of claim 10, wherein the permeable heater allows molten carbonate salt to flow through the permeable heater.

15. The method of claim 10, wherein the permeable heater has a diameter greater than a diameter of the conduit-in-conduit heater.

16. The method of claim 10, wherein the permeable heater has a diameter of about 2 times a diameter of the conduit-in-conduit heater.

17. The method of claim 10, wherein the conduit-in-conduit heater comprises an abandoned circulation system located in the formation.

18. The method of claim 10, wherein the permeable heater is formed by performing a cycle of:

allowing at least some molten carbonate salt to cool and at least partially solidify in the second portion;

providing additional heated molten carbonate salt into the second portion to melt at least some of the solidified molten carbonate salt; and allowing at least some of the melted molten carbonate salt to cool and solidify in the second portion.

19. The method of claim 10, wherein the wellbore comprises an open wellbore.

* * * * *